US006601637B2

(12) United States Patent
Toti

(10) Patent No.: US 6,601,637 B2
(45) Date of Patent: Aug. 5, 2003

(54) HINGE MECHANISM AND WINDOW COVER SYSTEM

(76) Inventor: Andrew J. Toti, 311 W. River Rd., Modesto, CA (US) 95351

( * ) Notice: Subject to any disclaimer, the term of this patent is extended or adjusted under 35 U.S.C. 154(b) by 0 days.

This patent is subject to a terminal disclaimer.

(21) Appl. No.: 09/846,500

(22) Filed: Apr. 30, 2001

(65) Prior Publication Data

US 2002/0043350 A1 Apr. 18, 2002

Related U.S. Application Data

(63) Continuation of application No. 09/078,427, filed on May 13, 1998, now Pat. No. 6,223,804.

(51) Int. Cl.[7] ..... E05D 15/26
(52) U.S. Cl. ..... 160/199; 160/235; 16/355
(58) Field of Search ..... 160/235, 84.04, 160/89, 170.1 V, 168.1 V, 199, 126, 206, 233, 234; 16/355

(56) References Cited

U.S. PATENT DOCUMENTS

| | | | | |
|---|---|---|---|---|
| 1,205,707 A | | 11/1916 | Cahill | 160/199 |
| 2,099,408 A | | 11/1937 | Packert et al. | 160/235 |
| 2,812,813 A | | 11/1957 | Zarnowski | 160/235 |
| 2,954,081 A | | 9/1960 | Recchione | 160/219 |
| 3,486,549 A | | 12/1969 | Rosenquist | 160/183 |
| 3,516,473 A | | 6/1970 | Rosenquist | 160/183 |
| 3,654,982 A | | 4/1972 | Labelle | 160/199 |
| 3,782,444 A | | 1/1974 | Rapp et al. | 160/235 |
| 3,799,237 A | | 3/1974 | Proserpi | 160/199 |
| 3,907,020 A | | 9/1975 | Root | 160/199 |
| 3,941,179 A | | 3/1976 | Root | 160/235 |
| 5,301,733 A | | 4/1994 | Toti | 160/84.1 |
| 5,638,881 A | | 6/1997 | Ruggles et al. | 160/168.1 R |
| 5,713,407 A | | 2/1998 | Judkins | 160/89 |
| 6,223,804 B1 | * | 5/2001 | Toti | |

FOREIGN PATENT DOCUMENTS

| | | | |
|---|---|---|---|
| CA | 1056294 | 6/1979 | 160/199 |

* cited by examiner

*Primary Examiner*—Blair M. Johnson
(74) *Attorney, Agent, or Firm*—Philip A. Dalton

(57) ABSTRACT

A hinge for assembling window covers is disclosed, along with associated window cover systems, including single blind systems and dual blind systems.

22 Claims, 22 Drawing Sheets

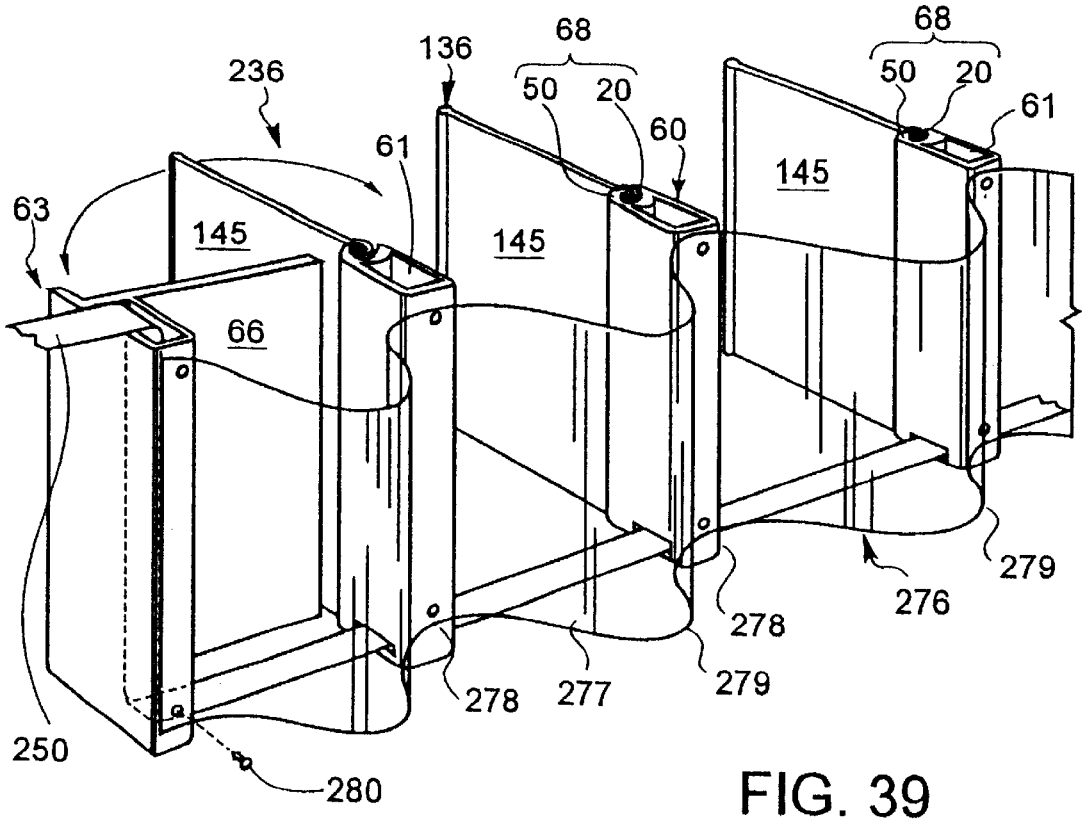
FIG. 39
FIG. 40
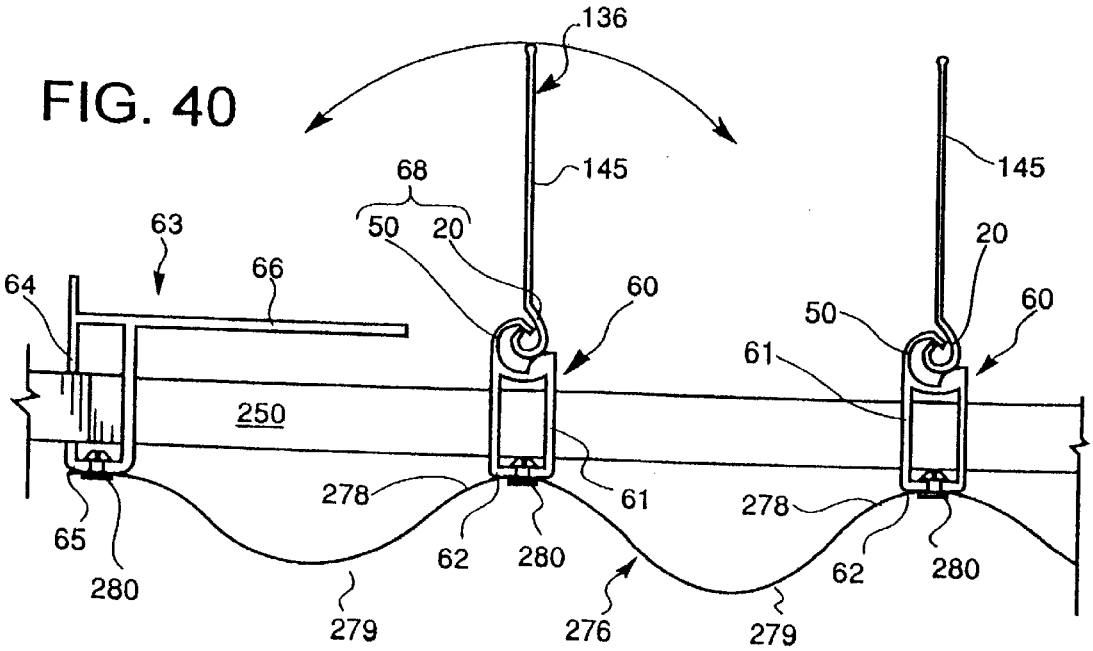

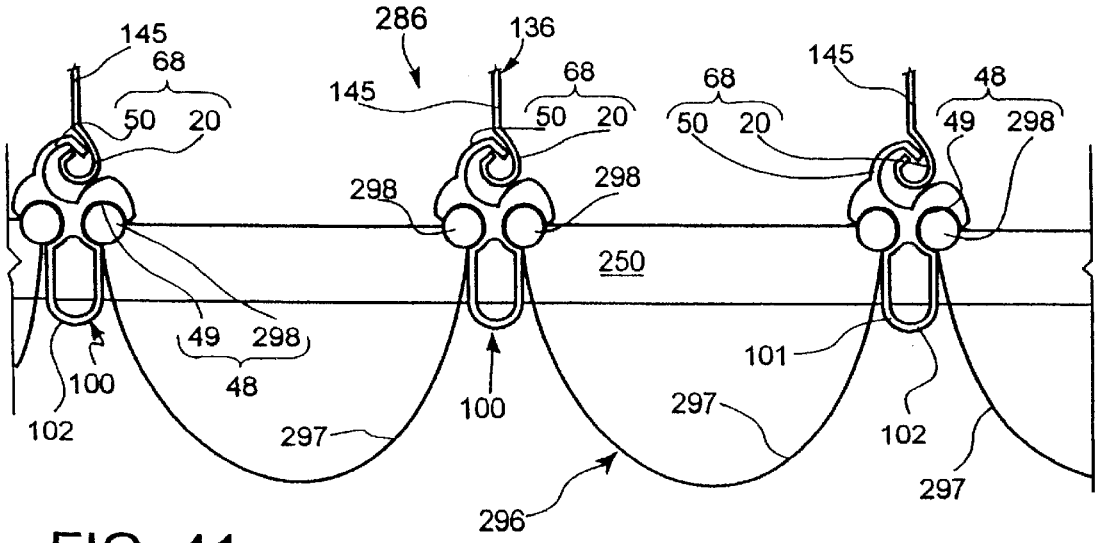
FIG. 41
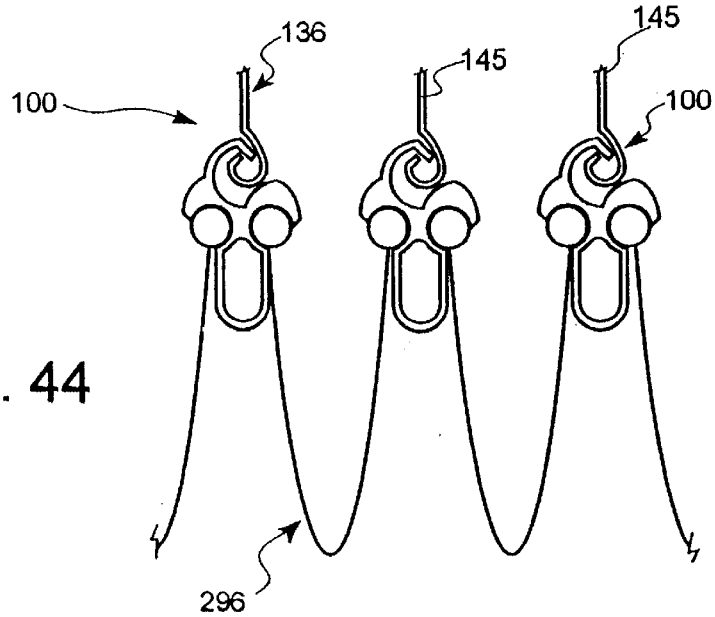
FIG. 44
FIG. 45
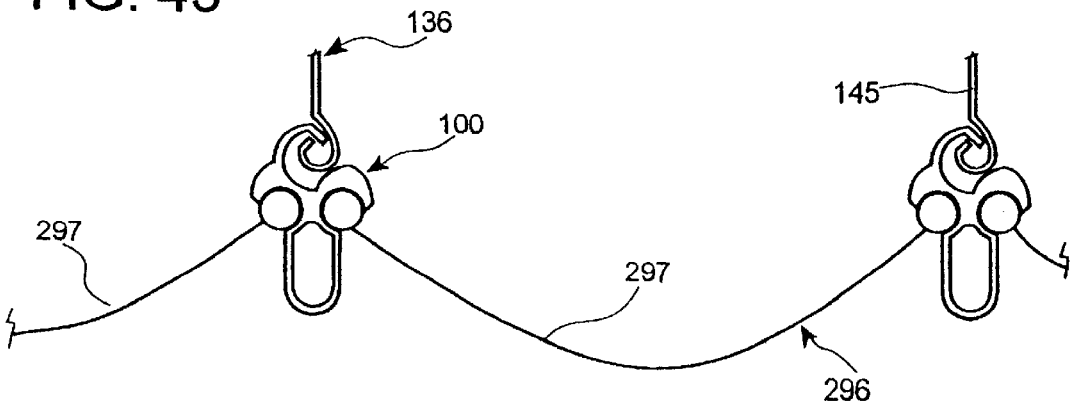

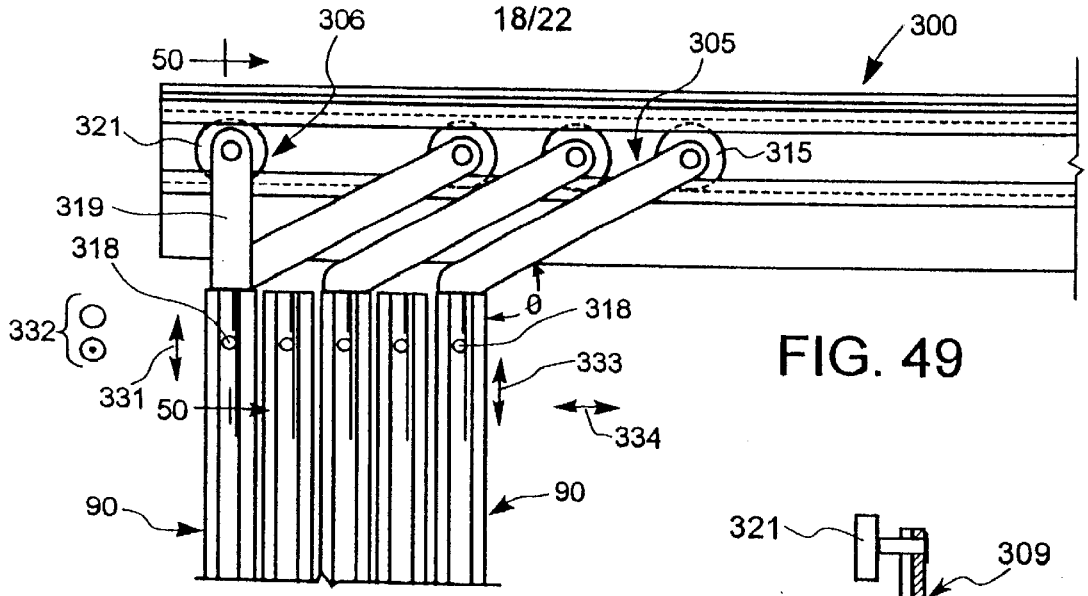
FIG. 49
FIG. 48
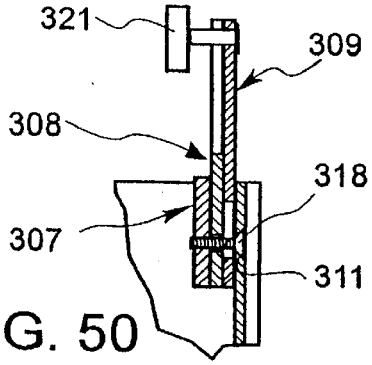
FIG. 50
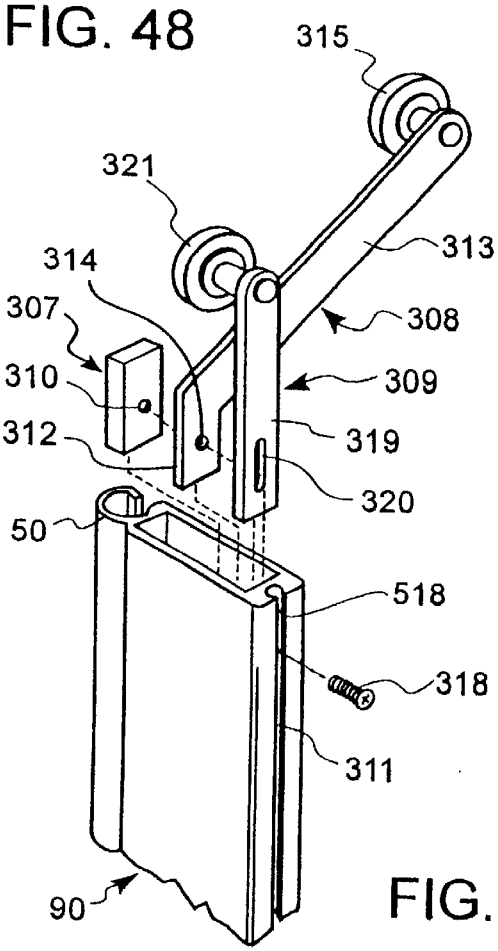
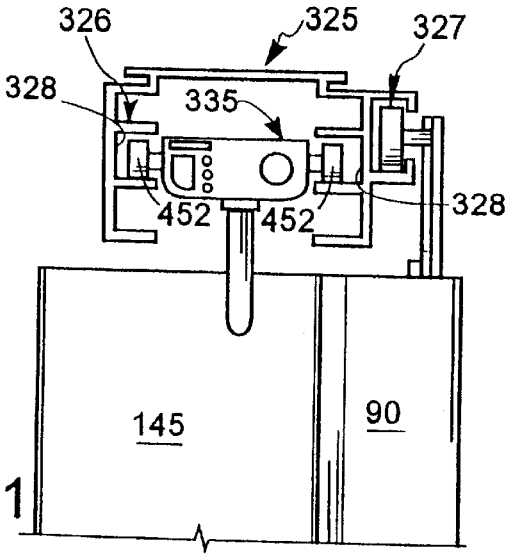
FIG. 51

HINGE MECHANISM AND WINDOW COVER SYSTEM

This is a continuation of application Ser. No. 09/078,427, filed May 13, 1998, scheduled to issue May 1, 2001 as U.S. Pat. No. 6,223,804.

1. BACKGROUND OF THE INVENTION a. Field of the Invention

The present invention relates generally to window cover systems and, in particular, to an improved hinge suitable for use in window cover systems and to window cover systems using the hinge.

b. Definitions and Applicability

As used here, the word "blind" refers to slat structures such as so-called venetian (horizontal slat) blinds, or vertical slat blinds, or so-called mini-blinds, to single and multiple pleat folding structures, and to flat, sheet structures such as the covers used in roller blinds. "Blind" may also refer to box, hollow and cellular pleat structures. In this document, "blind" and "cover" frequently are used generically, in that "cover" includes "blind" and vice versa. It is believed which meaning is intended—the generic or the specific—will be apparent from the context. The terms "box" pleat blind, "hollow" pleat blind and "cellular" pleat blind are used interchangeably. Also, here the words "carrier," "trolley" and "roller" are used interchangeably.

The present invention is applicable generally to vertically oriented window cover systems, primarily to slatted covers, but also to pleated, and to cellular pleat covers. It is understood that "window," as used for example in "window covers," includes windows, doorways, openings in general and even non-opening regions to which "window covers" are applied for decoration, display, etc.

c. Current State of the Relevant Field

Covers such as vertical slat blinds typically are difficult to control, because the cover comprises individual slats which should be maintained in the desired vertical orientation during operation of the blind. The operation of such blinds may include sliding the array of slats which comprise the blind open and closed along the horizontal direction and pivoting the individual slats open and closed in unison about vertical axes through each slat.

Conventional control systems opt for simplicity, which reduces control, or for control, which requires cumbersome apparatus. For example, in one simple approach, the slats are mounted at their upper ends to carriers or trolleys, etc. which in turn are mounted for traversing movement along a track which contains mechanisms for traversing the slats horizontally and pivoting the slats. Due to their unrestrained lower ends, it is virtually impossible to maintain the alignment of the slats, which tend to wave and to undulate in the slightest air current and when the blinds are being opened or closed.

Some systems are designed to more precisely control the movements of traversable slats by mounting the lower end of the slats in a bottom traverse track. Typically, the traversing and pivoting operations of the slats are controlled from one end of the slats, from the top traverse track, with the result that control is imperfectly transmitted along the slats and the bottom ends tend to bind in the lower traverse track. Furthermore, and in particular when used indoors, the lower traverse tracks are an obstruction unless mounted in a recess, and quickly accumulate dirt, thus presenting an unpleasing appearance and tending to bind during operation.

Conventional vertical slat blind systems also have shortcomings concerning privacy. Such systems require a choice between privacy and illumination. Thus, in a room having windows and/or doors covered by slat blinds, occupants of the room are afforded complete privacy only when the blinds are completely closed (and if the blinds maintain their position, that is, if the blinds do not move or undulate). Clearly, when the slat blinds are completely closed and maintain their closure, they block sunlight from illuminating the room via the windows. Conversely, if a blind is opened to some degree to admit daylight, occupants or contents of the room may be visible to an external observer through the window, to a degree determined by the inclination and spacing of slats in the blind and the distance of the observer from the window.

There is a need for a vertical slat blind type of window cover system which is simple in construction, yet maintains the selected positioning and orientation of the individual slats and the array. In addition, there is a need for a cover system which affords privacy for occupants of a room, while still retaining the ability to provide an illumination control function, that is, to permit illumination without loss of privacy. Such a system should also be characterized by low cost and by ease of installation and maintenance, and should be pleasing in appearance.

2. SUMMARY OF THE INVENTION

In one embodiment, a window cover system in accordance with the present invention comprises a vertical slat blind arrangement including an upper traverse track; carriers or trolleys suspended from the traverse track; a mechanism for horizontally traversing the carriers along the track; and an array of vertically oriented slats suspended from the carriers for opening and closing traversing movement along the traverse track. Adjacent slats are pivotally joined along their vertical length by a hinge mechanism comprising a first generally c-shaped hook or hinge member extending along the length of a first of the adjacent slats and a second mating, generally c-shaped hook or hinge member extending along the length of the second of the adjacent slats.

In a further embodiment of the invention, the slat-to-slat hinge attachment mechanism comprises individual mating hinge members formed along the edges of adjacent slats and adapted to easily and quickly and slidably attach along one another without a need for special tools or skills. As such, the vertical slat blind system need not be specially configured and the slats can be easily attached and removed from the blind individually or en masse, for inspection, repair or replacement.

In another more specific embodiment, not exhaustive, the first and second hinge members comprise first, second and third sections. The first and second sections have different radii and the third section is a generally straight section which defines an opening adjacent the first section. In combination, these sections provide approximately 180° rotation to the hinge in which at one extreme of pivotal movement, the inside surface of the third section of the first hinge member is captured against the inside surface of the second hinge member and, at the second extreme of pivotal movement, opposite the first extreme, the outside surface of the third section of the first hinge member is captured against the inside of the second hinge member.

Other embodiments of the present invention are described in the specification, drawings and claims.

3. BRIEF DESCRIPTION OF THE DRAWINGS

The above and other aspects of the invention are described below in conjunction with the following drawings.

FIG. 39 is a partial perspective view of a dual blind window cover system comprising a vertical slat blind and a vertical roll pleat blind, both of which are mounted to ribbed stabilizer hinge members and are controlled by a tape.

FIG. 40 is a horizontal sectional view of the cover of FIG. 39.

FIG. 41 is a partial horizontal sectional view of an alternative to the dual blind of FIG. 39, an embodiment in which the vertical roll pleated blind comprises separate panels mounted along their opposite edges to adjacent ribbed stabilizer hinge members.

FIGS. 44 and 45 are partial horizontal sectional views of the system of FIG. 42, illustrating a blind (almost) open condition and a blind closed condition, respectively.

FIG. 48 is an exploded view of one of the stiffener members of FIGS. 46 and 47.

FIG. 49 is a partial vertical elevation view illustrating the mounting and overlapping close-packing of the stiffeners and associated blinds of FIGS. 46 and 47.

FIG. 50 is a sectional view taken along lines 50—50 in FIG. 49.

FIG. 51 is an end view of the track of FIGS. 46 and 49, illustrating the capture of the carriers and stiffeners.

4. DETAILED DESCRIPTION OF THE PREFERRED EMBODIMENTS(S)

a. Hinge Members 10 and 20, Double Action, Self-locking Hinges 8 and Interconnected Vertical Slat Blind(s) (FIGS. 1, 2, 5–11)

Figure 1:
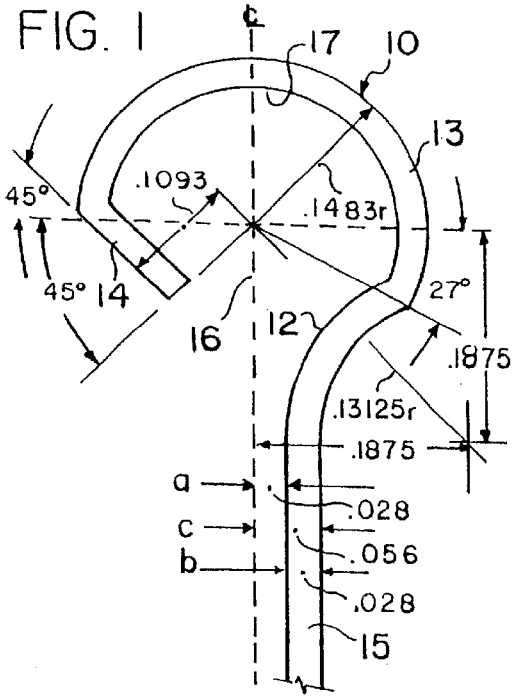
FIGS. 1 and 2 are horizontal sectional views of mating hook or hinge members which in combination comprise an embodiment of the dual action hinge mechanism in accordance with the present invention.
Figure 2:
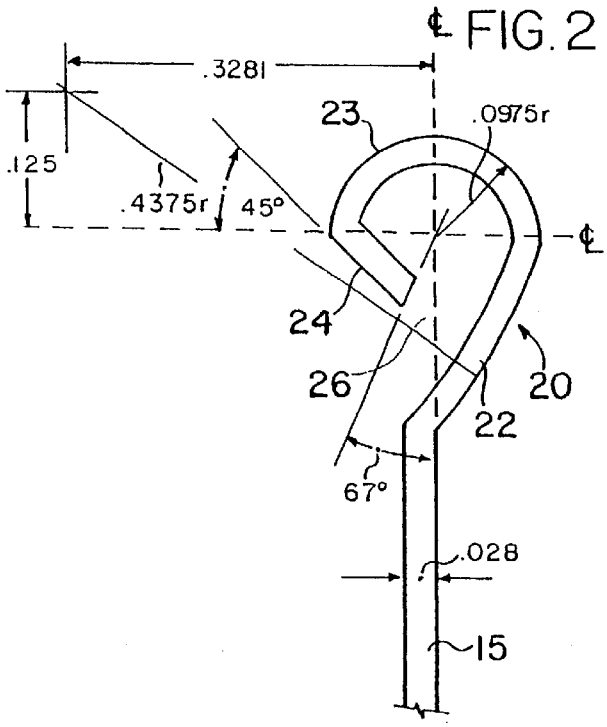
Figure 5:
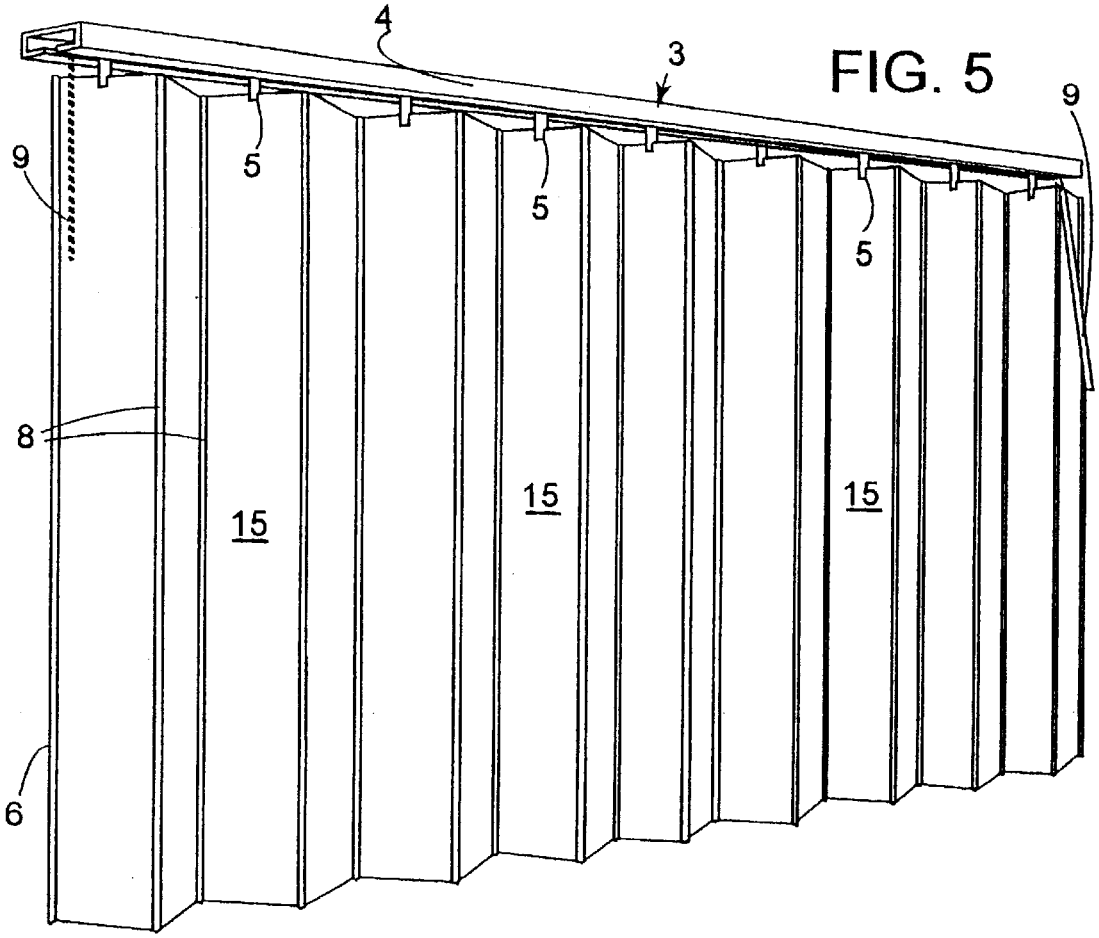
FIG. 5 is a perspective view of a vertical interconnected-slat blind window cover system, in accordance with the present invention, which uses the hinges of FIGS. 1 and 2.
Figure 6:
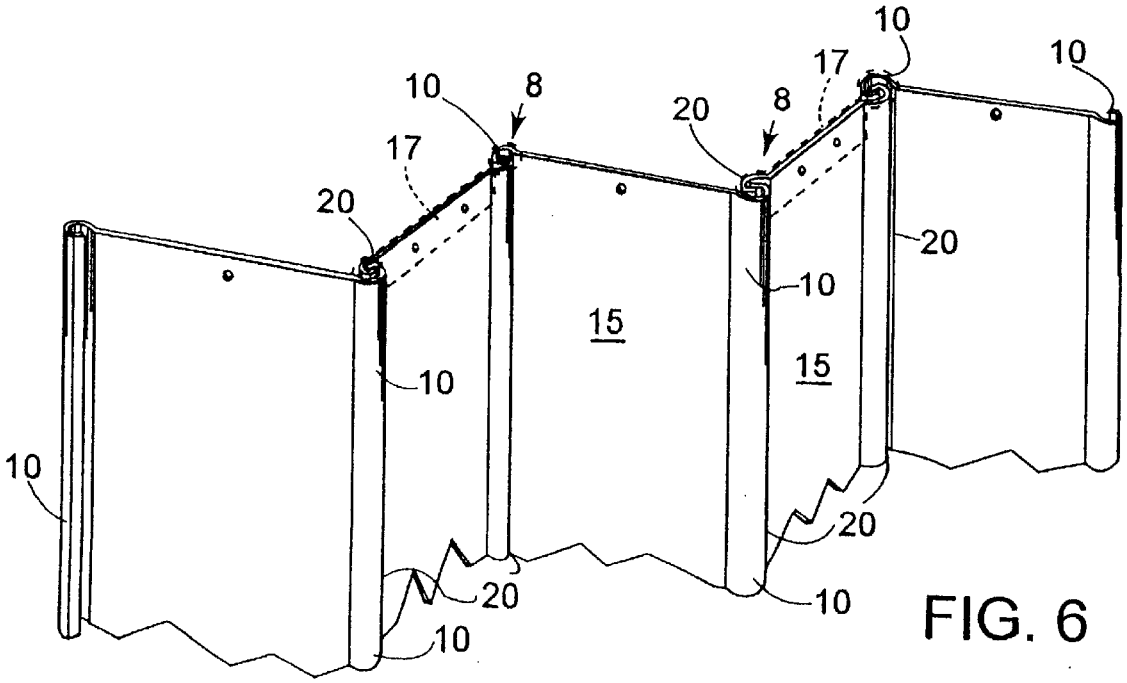
FIG. 6 is a n enlarged partial, perspective view of the cooperating slat and hinge members in the window cover of FIG. 5.

Turning now to the drawings, FIGS. 1 and 2 depict an embodiment of mating hook or hinge members 10 and 20, respectively, which form one preferred embodiment 8, FIGS. 5 and 6, of a hinge mechanism in accordance with the present invention. FIGS. 5 and 6 depict an application of the hinge 8, in a vertical slat blind window cover system 3 comprising a horizontal traverse track 4 mounted above a window, door or other space to be covered, carriers or trolleys or rollers 5 suspended from the track for traversing along the track, and a slat blind 6 comprising vertical slats 15 joined by locking hinges 8 comprising mating hinge members 10 and 20 formed along the edges of the adjacent slats.

Typically, the carriers 5 are mounted at a spatially off-center position along the horizontal front-to-back dimension of the slats 15, at the approximate horizontal center of gravity front-to-back, to facilitate vertical hanging of the slats. The hinge members 10 and 20 can be made of various material such as plastic and metal including aluminum, and can be formed by various methods, including plastic extrusion, aluminum extrusion, and metal roll forming. As shown in FIG. 5, preferably, every other slat (one slat of each folding pair of slats) is suspended by a carrier 5 from the track 4. One end of the blind 6 can be stationary, that is, is fixedly mounted to the track 4 or at the edge of the window or other space to be covered and a wand 9 is attached to the opposite, free end of the blind for pushing and pulling the blind open and closed along the track. Alternatively, both ends of the blind 6 can be movable and wands 9 can be attached to both ends for selectively opening and closing each end and for selectively positioning the blind and the openings along the traverse track 4.

Figure 8:
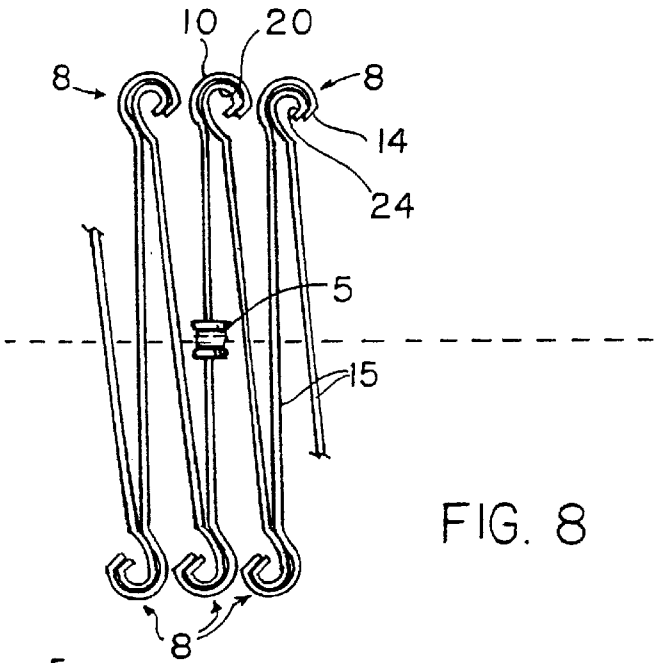
FIGS. 7 and 8 are horizontal sectional views of a section of a slat blind of the type used in FIGS. 5 and 6, showing respectively the blind closed (slats unfolded) condition FIG. 7, and the blind open (slats folded or close-packed) condition, FIG. 8.
Figures 16, 17, 19:
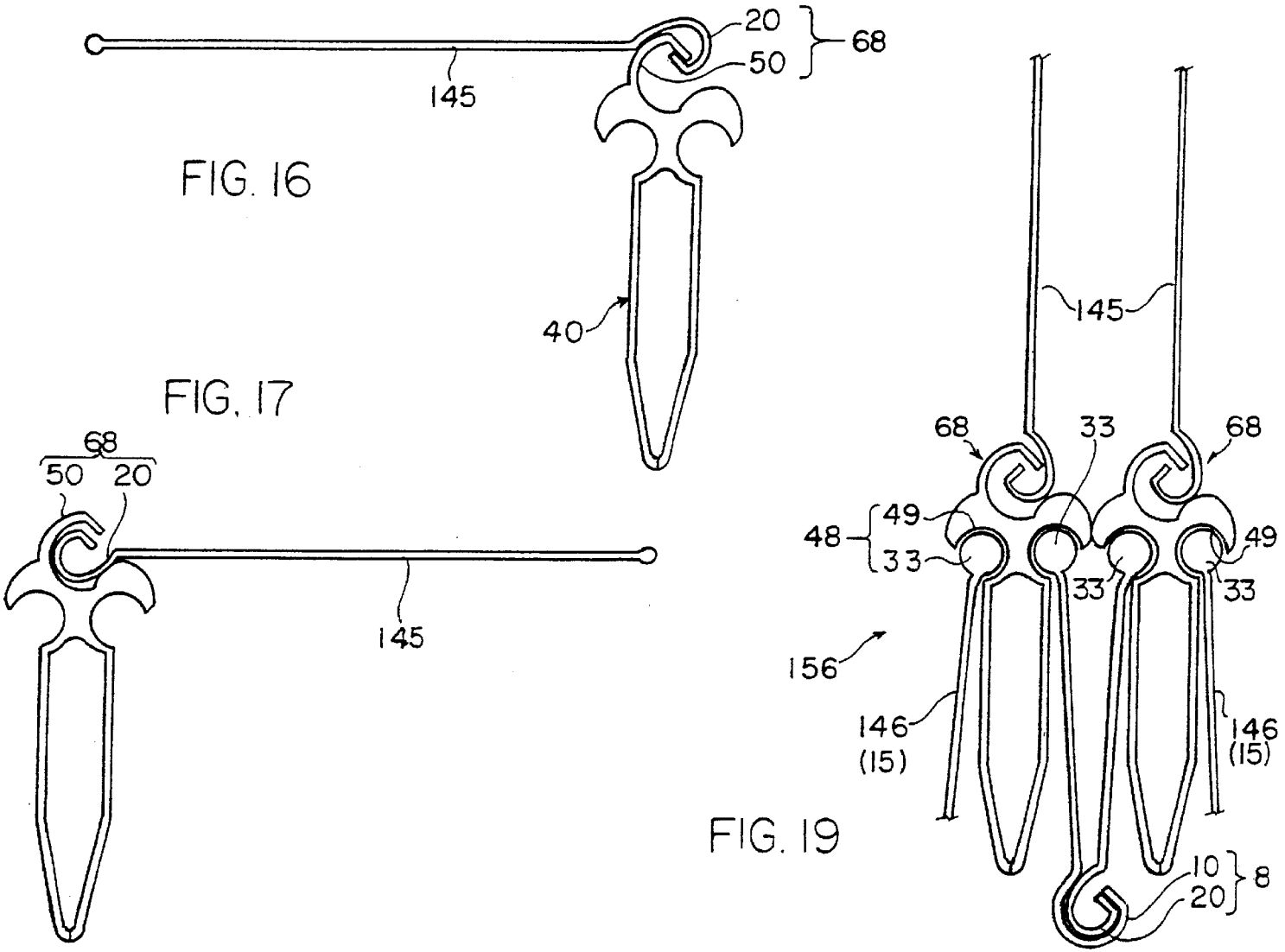
FIGS. 16–23 illustrate details of the structure and operation of the spacer-supported slat blind of FIGS. 14 and 15.

Returning to FIG. 1, that figure depicts a horizontal cross-section of a vertically extending, relatively large radius hinge member which is designated generally by the reference numeral 10. In the figure, numeral 15 designates an exemplary vertically extending slat used in covers such as blind 6, FIG. 5. Referring also to FIG. 6, in the exemplary depicted embodiment, hinge member 10 preferably is formed integrally with, and along at least a section of one longitudinal edge of, the vertically extending slat such as 15. In the illustrated plane transverse to the longitudinal axis of the slat 15, hinge member 10 comprises a first section 12 having a relatively small dimension, reverse or concave radius. The first section 12 extends between the slat edge and a second hinge section 13 having a relatively large dimension convex radius. In turn, the second section 13 extends between the first section 12 and a generally straight section 14 which, in conjunction with section 12 defines an opening 16. Specifically, as illustrated for example in FIG. 1, the outer end of first section 12 and the outer end of the third or lip section 14 define the opening 16 therebetween, into the associated cavity. Thus, the first section 12 of the relatively large hinge member 10 is substantially entirely within and protrudes into the cavity 16 and engages the first section 22 of the relatively small hinge member 20 as the hinge members pivot from a first limit of pivotal movement (e.g. FIGS. 7 and 16) toward a second limit of pivotal movement (e.g. FIGS. 8 and 17), shifting the outside surface of the relatively small hinge member 20 against the inner surface including the third, lip section 14 of the relatively large hinge member 10 and capturing the relatively small hinge member 20 within the relatively large hinge member 10 (FIGS. 8 and 17). The preferred relative dimensions for the hinge member 10 are listed in FIG. 1, and include the following. Section 12 comprises a radius of 0.13125R and occupies approximately 63°. Section 13 comprises a radius of 0.1483R and approximately 207°. Section 14 is spaced 0.1093 in. from the center of the hinge member and occupies 45°. The edge of slat 15 is offset approximately 0.056 in. from the centerline of the hinge member 10 (offset c=a+b). Opening 16 defined between the first and third sections spans approximately 45°–55°.

FIG. 2 depicts a horizontal cross-section of a vertically extending, relatively small radius hinge member (small relative to the radius of hinge member 10), which is designated generally by the reference numeral 20. Hinge member 20, like hinge member 10 is an integral part of, preferably is formed along at least a section of one edge of, the associated vertically extending slat such as 15. In the plane transverse to the longitudinal axis of the slat 15, hinge member 20 comprises a first section 22 having a relatively large dimension radius. The first section 22 extends between the slat edge and a second hinge section 23 having a relatively small dimension radius. In turn, the second section 23 extends between the first section 22 and a generally straight section 24 which, in conjunction with section 22 defines an opening 26. Specifically, as illustrated for example in FIG. 2, the cavity opening 26 is defined between the outer end of the third, lip section 24 and a point along the first section 22, preferably intermediate the ends of the first section 22. The preferred relative dimensions for the hinge member 20 are listed in FIG. 2 and include the following. Section 22 comprises a radius of 0.4375R and occupies approximately 90°–95°. Section 23 comprises a radius of 0.0975R and approximately 180°. Section 24 is spaced 0.0781 in. from the center of the hinge member 20 and occupies approximately 67°. The edge of slat 15 is located approximately on the centerline of the hinge member 20. Opening 26 spans approximately 23°.

The hinge member 10 can be mounted to the hinge member 20 by positioning adjacent slats 15 end-to-end with hinge member 10 inside hinge member 20, then sliding the slats longitudinally together. Referring in particular to FIG. 6, in the illustrated hinged slat arrangement, both opposite longitudinal edges of each slat 15 can be formed into one or the other of the large hinge member 10 or the small hinge member 20. The opposite longitudinal edges of one slat 15 form large hinge members 10 which face in opposite directions, while the opposite longitudinal edges of the adjacent slats 15 form small hinge members 20, which also face in opposite directions, for mating with the large hinge members 10 of the intermediate slats to form the hinges 8. The configuration and dimensions of the hinge members provide a double action shifting radius relative to one another which permits the hinge 8 to be pivoted between (1) a fully extended or unfolded or closed condition in which the nearly parallel slats approximate a straight line, FIG. 7, and (2) a close-packed, folded or open condition in which adjacent slats are nearly parallel, folded flat against one another, FIG. 8. The three-section mating members 10 and 20 of the hinge 8 and the associated openings permit unencumbered movement between the close-packed folded condition and the flat unfolded condition, yet lock the male hinge member 20 to the female hinge member 10 and prevent the members 10 and 20 from separating in the folded, unfolded and intermediate orientations. The openings 16 and 26 permit pivoting of the hinges, yet are sufficiently small to prevent separation.

The hinges 8 can be formed along the entire vertical length or substantially the entire vertical length of the blind slats, or along sections such as top and bottom sections; top, intermediate and bottom sections; and top and intermediate sections.

Figure 7:
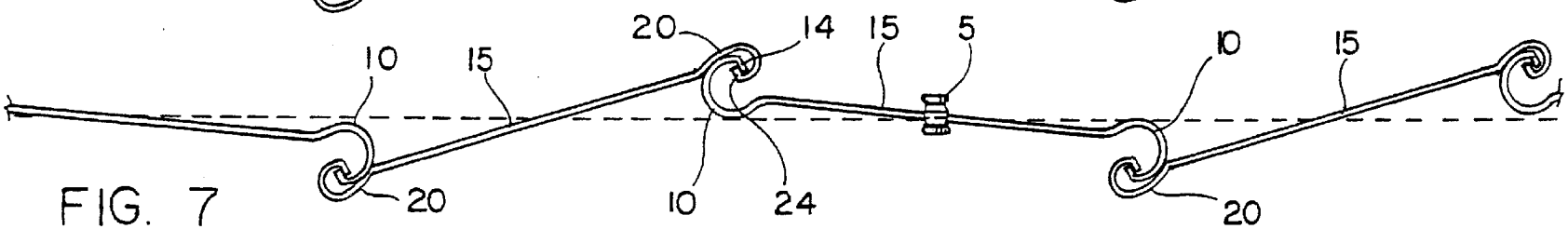

In the flat, fully unfolded condition or orientation illustrated in FIG. 7, the openings 16 and 26 allow the inside surface of straight section 24 of the hinge member 20 to pivotally engage the inside surface of straight section 14 of the hinge member 10 and prevent the hinge members from disengaging. This is the closed condition of the blind 6 of the illustrated window cover system 3, FIG. 5, in which the blind 6 comprises an array of vertical slats 15 joined together by the locking pivot hinges 8 comprising mating hinge members 10 and 20.

When the blind is opened, for example by traversing control wand 9 along the traverse track 4, the hinge member 20 pivots within hinge member 10 so that the outside surface of hinge member 20, specifically the outside surface of straight section 24, engages and is captured against the inside surface of the hinge member 10 and the straight section 14 thereof. See FIG. 8. Reversible rotation of the hinge 8 and the associated reversible opening and closing movement of the blind 6 is effected by rotating male hinge member 20 within female hinge member 10 between the extreme orientation in which the outside surface of the inner hinge member 20 is captured against the inside surface of the outer hinge member 10 and the opposite extreme orientation in which the inside surface of the inner hinge member is captured by the inside surface of the outer hinge member.

Referring again to FIG. 5, as mentioned above, wand(s) 9 is (are) used to traverse the blind 6 back and forth along the traverse track, to effect opening and closing. Mechanisms for operating blinds are well known to those familiar with the art and, thus, a detailed discussion of such mechanisms is not required. Furthermore, due to the hinges 8, the slats 15 automatically pivot closed (FIG. 7) and open (FIG. 8) when one end of the blind is moved relative to the other. Thus single and double end traversing arrangements are easily implemented by mounting one end of the blind stationary and attaching a wand 9 to the opposite end, or by mounting wands to the movable, opposite ends.

Figure 10:
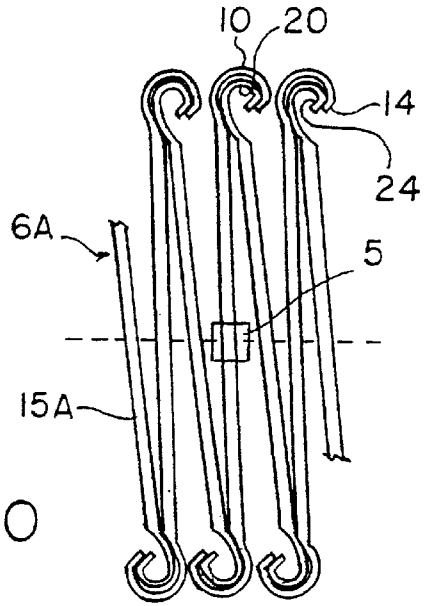
FIGS. 9 and 10 are horizontal sectional views corresponding to FIGS. 7 and 8, of an alternative insulated slat, vertical slat blind system.
Figure 9:
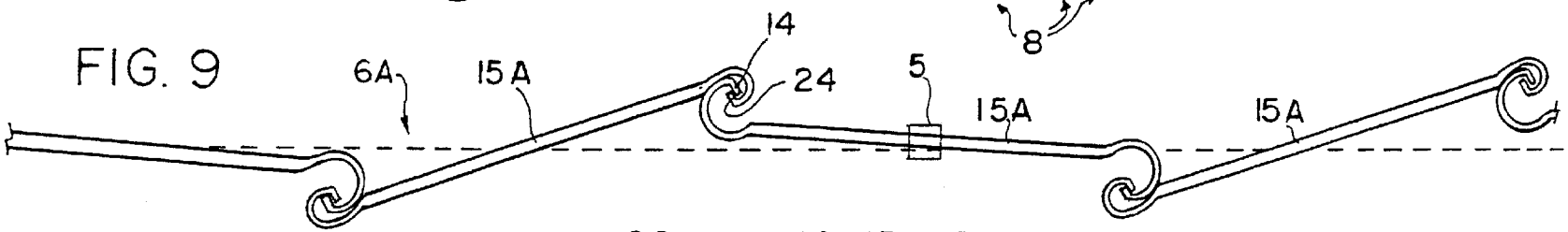

FIGS. 9 and 10 depict insulated blinds 6A comprising relatively thick, insulated panel slats 15A. In other respects the blind 6A corresponds to the blind 6, including the incorporation of hinge members 10 and 20 which form hinges 8. The views and conditions depicted in FIGS. 9 and 10 correspond respectively to those of FIGS. 7 and 8.

Figure 11:
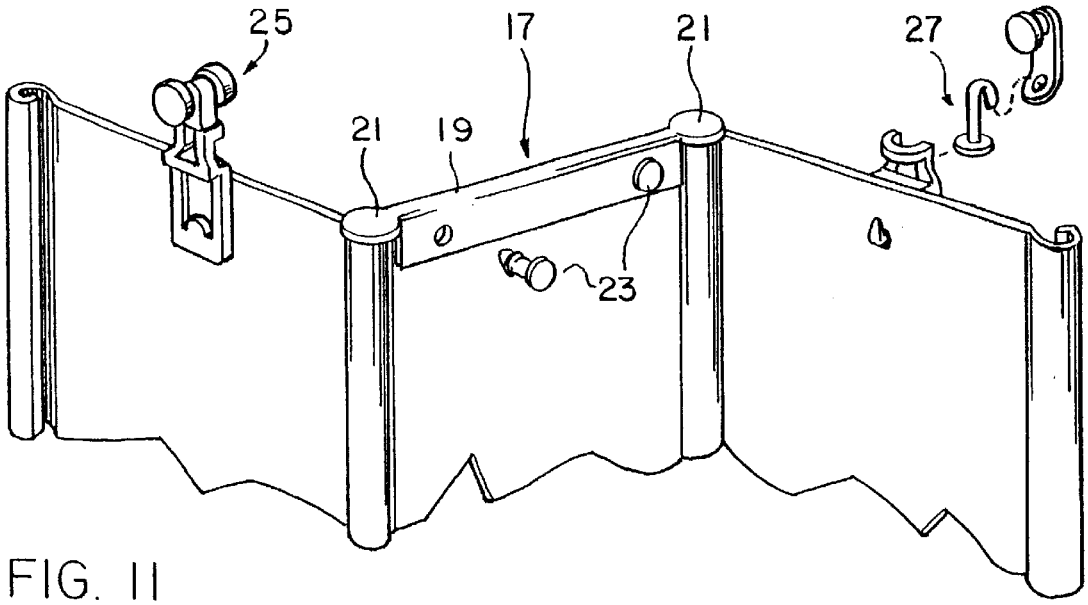
FIG. 11 is a partial perspective view similar to FIG. 6, illustrating mounting of the retainers and exemplary carriers.

FIGS. 6 and 11 depict retainers 17 which keep the assembled blind slats 15 from separating. The retainers are shown in phantom in FIG. 6. Referring to FIG. 11, the retainers 17 comprise an elongated support member 19 of L-cross section which rests along the top edge and side of the associated slat. Enlarged, generally circular end sections 21 are positioned over the hinges, illustratively hinges 8. The retainers 17 are secured to holes in the associated slats by bayonet-end pins or rivets 23 or other fastening devices. The retainers 17 can be used on other covers and blinds, for example, cover 113, FIGS. 12, 13. FIG. 11 also depicts two carriers 25 and 27 which suspend the associated blind from the track traverse mechanism. The two different types of carriers 25 and 27 are depicted in the same figure to simplify illustration. Typically, one type or the other would be used on a blind.

b. Ribbed Stabilizer Hinges as Integral Components of Vertical Slat Blind(s) (FIGS. 3, 4, 12 and 13)

Figure 4:
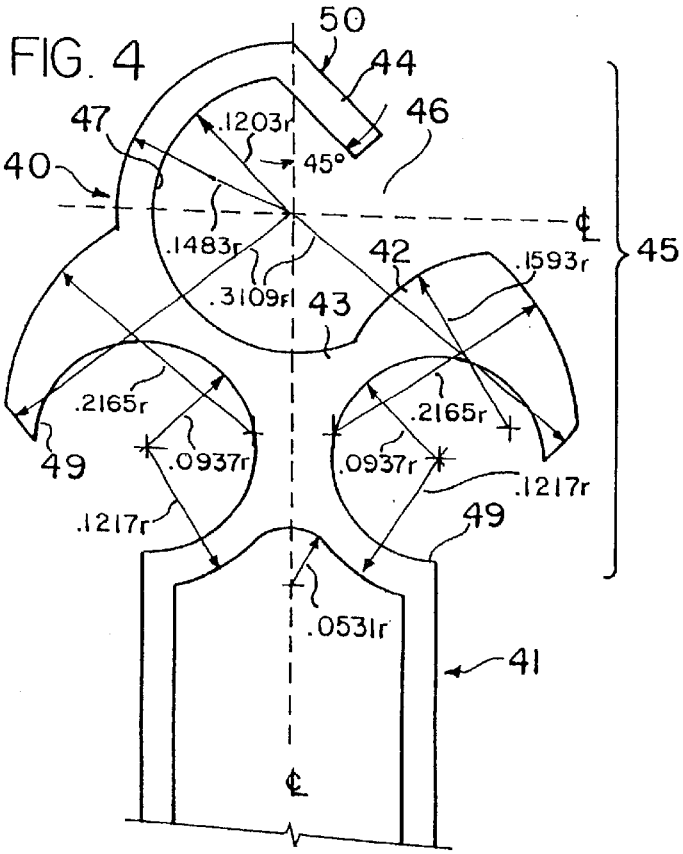
FIG. 4 is a horizontal sectional view of a multiple hinge member which is an alternative to the hinge member of FIG. 1.

FIG. 4 depicts an alternative to hinge member 10, in the form of a ribbed stabilizer hinge member 40 (also called master hinge rib stabilizer, and for brevity, hinge member or member). Hinge member 40 comprises an elongated hollow stabilizer member 41 and a head 45 comprising a plurality of hinge members. Head 45 comprises a pair of opposite side generally circular socket-type hinge members 49 and a front socket-type hinge member 50 which is similar to hinge member 10, FIG. 1. That is, relatively large, female hinge member 50 comprises a first, relatively small dimension reverse radius section 42, a second relatively large dimension arcuate section 43 and a third, straight section 44 which collectively form socket 47. Opening 46 is defined between first, reversed radius section 42 and third, straight section 44.

Figure 3:
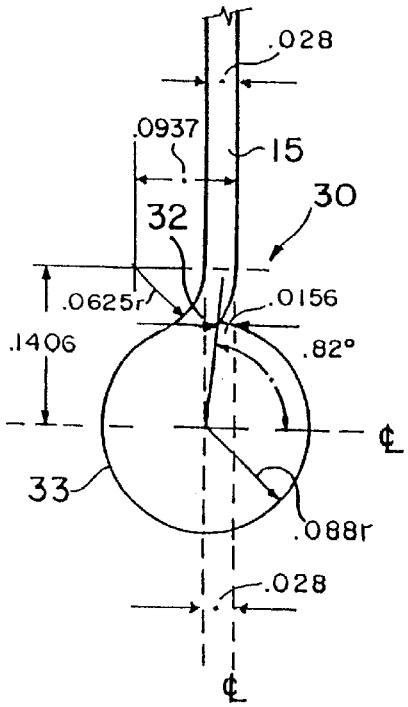
FIG. 3 is a horizontal sectional view of a hinge member which is an alternative to the hinge member of FIG. 2.

FIG. 3 depicts associated relatively small radius, male hinge member 30 comprising a generally circular cross-section head 33 joined by a reverse radius section 32 to the edge of slat 15. The circular head 33 is slightly smaller than the sockets 49 and 50 of head 45. As a result, the head 33 is captured by, and is free to rotate within, the two female hinge members 49. Head 33 does not include the three sections of hinge member 20 and as a result hinge 48 (see, for example, FIGS. 12–15 and 18–21) formed by socket 49—head 33 pivots through an arc of about 60°, which is less than the pivotal travel of the hinge 8 (eg, FIGS. 5–11) formed by hinge member 10—hinge member 20, or hinge 68 (eg, FIGS. 15–20) formed by hinge member 50—hinge member 20.

Figure 12:
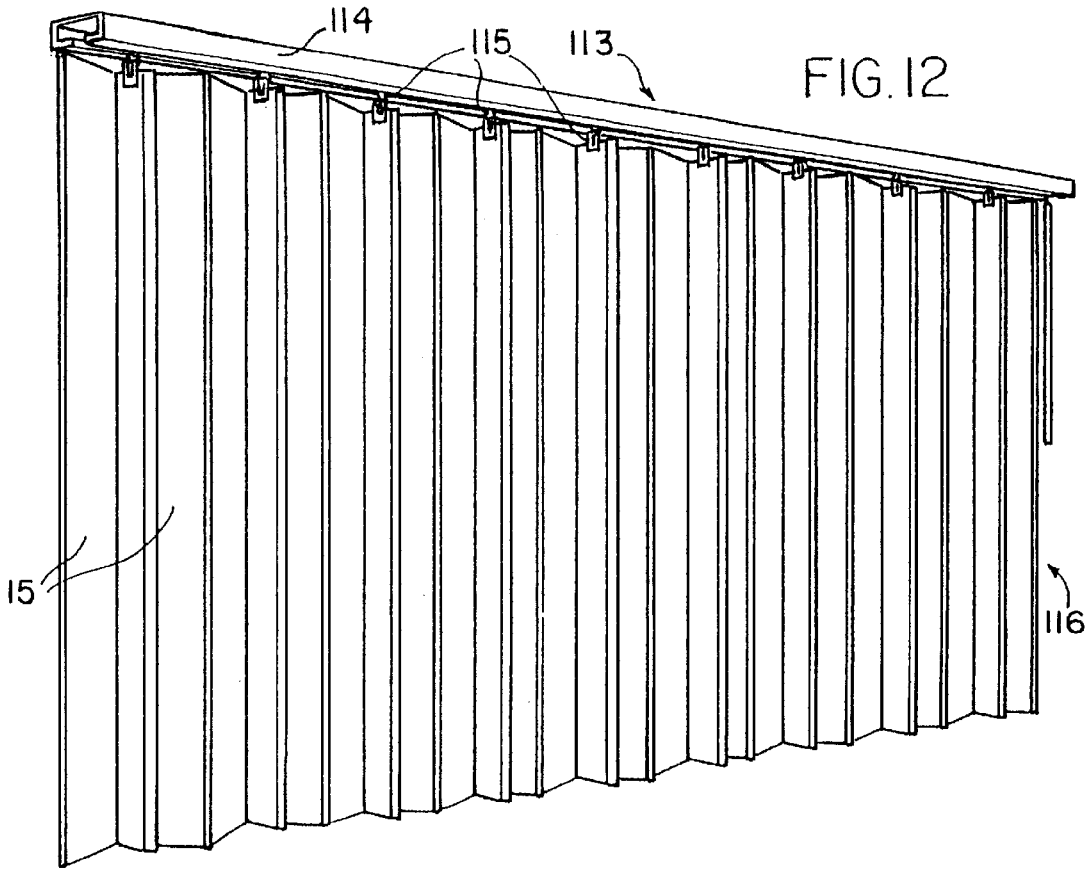
FIG. 12 is a perspective view of a vertical interconnected-slat blind window cover system which uses an alternative array of hinges, in accordance with the present invention, comprising an array of alternating double action hinges and ribbed stabilizer hinge members.
Figure 13:
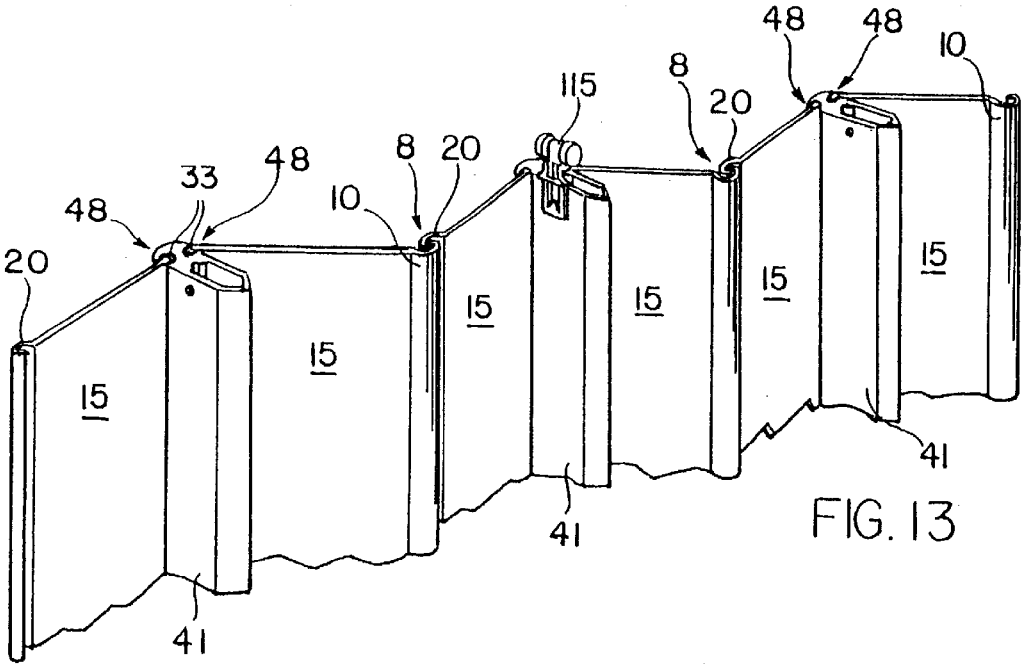
FIG. 13 is an enlarged partial, perspective view of the slat blind of FIG. 12, showing the arrangement by which the slats are interconnected by ribbed stabilizer hinge members.

FIGS. 12 and 13 depict a slat blind window cover system 113 which utilizes the ribbed stabilizer hinge member 40, FIG. 4, in an application which does not require the socket 50, and alternating hinges 8 and 48. The cover system 113 may comprise a conventional traverse track 114, slat blind 116, and rollers or carriers or trolleys 115 suspended from the track for traversing along the track. As is true of the other covers and carriers disclosed here, the carriers 115 of cover 113 may comprise wheels which simply are captured within a channel in the track 114 so that the carriers are free to roll along the channel when wand 9 is moved back and forth. Alternatively, for applications which require that the carriers 115 be pivoted or rotated, a conventional mechanism can be incorporated in the traverse track for traversing and pivoting the carriers. For example, using such mechanisms, the traversing and pivoting operations of the carriers and thus of the slats are controlled by traversing the wand 9 back and forth and rotating the wand about its longitudinal axis.

In the illustrated embodiment of cover system 113, the slats 15 are joined by alternating hinges 8 and 48 formed along the vertical length of the slats 15. Alternatively, the hinges 8 and/or 48 can be formed along one or more sections of the slats, for example, at top and bottom sections, at top and intermediate sections, or at top, intermediate and bottom sections. Opposite edges of one slat 15 comprise hinge member 30 (head 33) and hinge member 10, while the opposite edges of the adjacent slat comprise hinge member 20 and hinge member 33. The hinge members 10 and 20 form hinge 8. Adjacent hinge 48 is formed by ribbed stabilizer hinge member 40, specifically head 45, the socket 49 of which captures the head 33 of the adjacent hinge member 30. The carriers 115 are mounted to the bodies 41 of the rib hinge stabilizer members 40 and, as discussed above, are captured by the traverse track 114.

Figure 18:
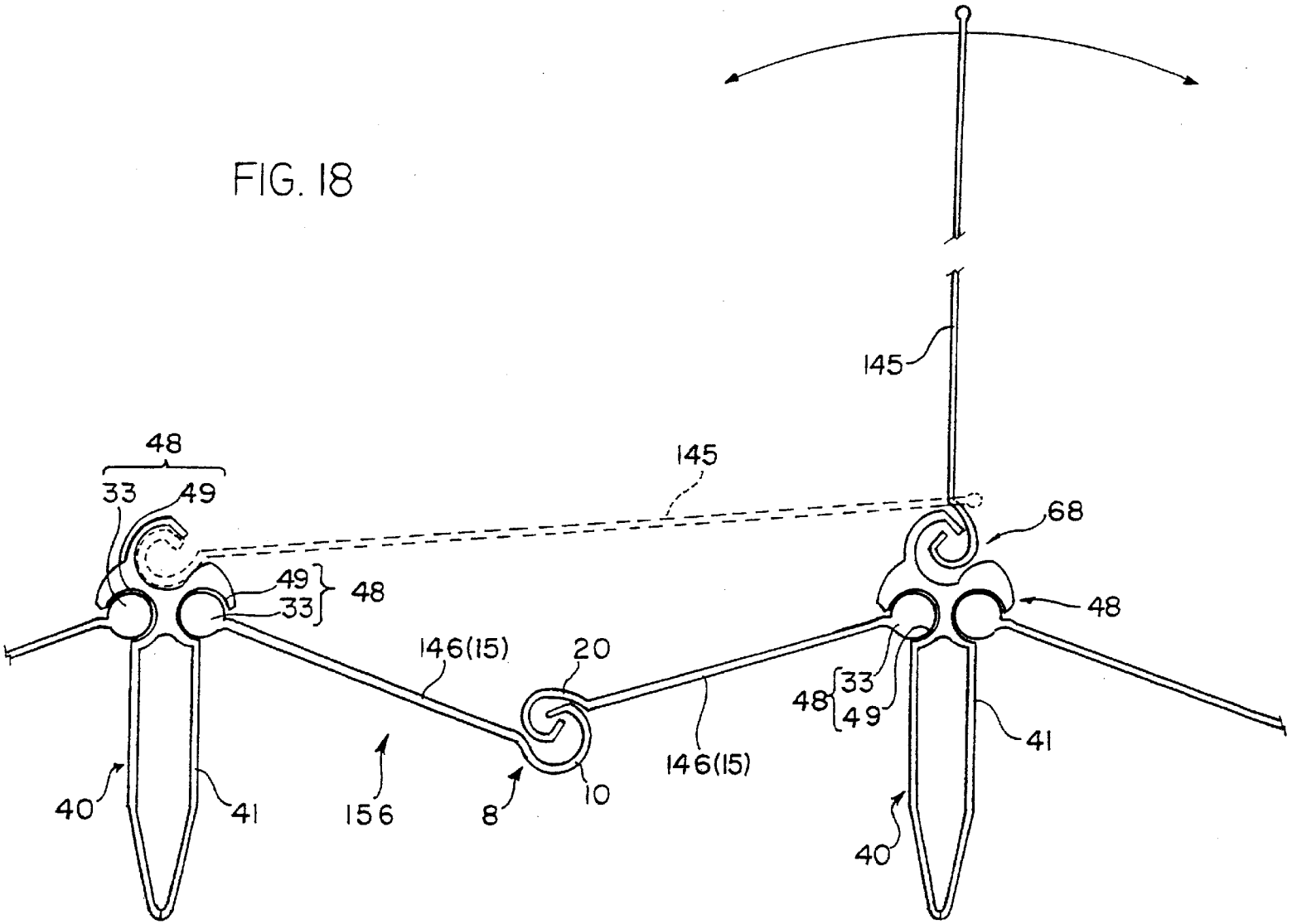
Figure 20:
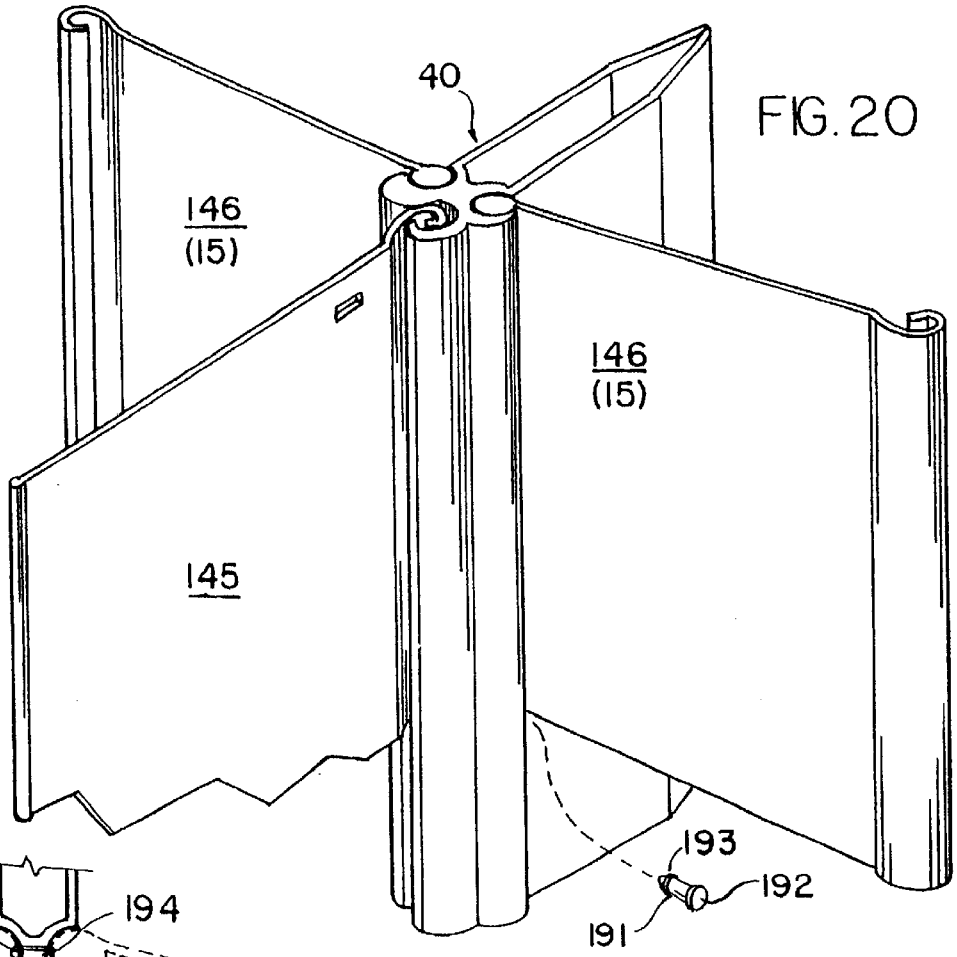
Figure 21:
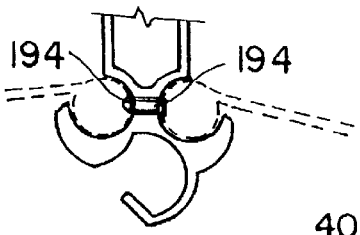
Figure 22:
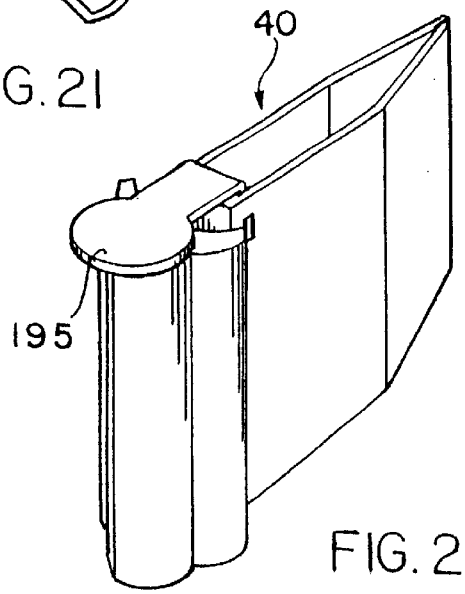

The operation of the blind 113 is easily understood with reference to FIGS. 18 and 19. (Although FIGS. 14–23 depict a slat blind system 133 which is different from the system 113 shown in FIGS. 12 and 13, the operation of hinges 8 and 48 is the same in the two systems 113 and 133. To facilitate understanding, the slat reference numerals 15 associated with system 113 are shown in parentheses in FIGS. 18 and 19). Hinge 48 pivots about 90°, which in combination with the pivoting of adjacent hinges 8, allows the slat blind 116 to be fully unfolded (blind closed) in the manner of blind 6, see FIG. 18, and to be close packed (blind open) in the manner of blind 6, see FIG. 19. Thus, the use of hinges 8 and 48 in blind 116 provides the combined advantages of the close packing and full unfolding which are characteristic of blind 6 as well as the reinforcement and multiple hinge versatility of ribbed stabilizer hinge member 40 and its head 45.

c. Ribbed Stabilizer Hinge Members 40 as Integral Components of Combined Vertical Slat Blind and Spacer Assembly Which Includes Hinge Members 10, 20 and 30 (FIGS. 14–23)

Figure 14:
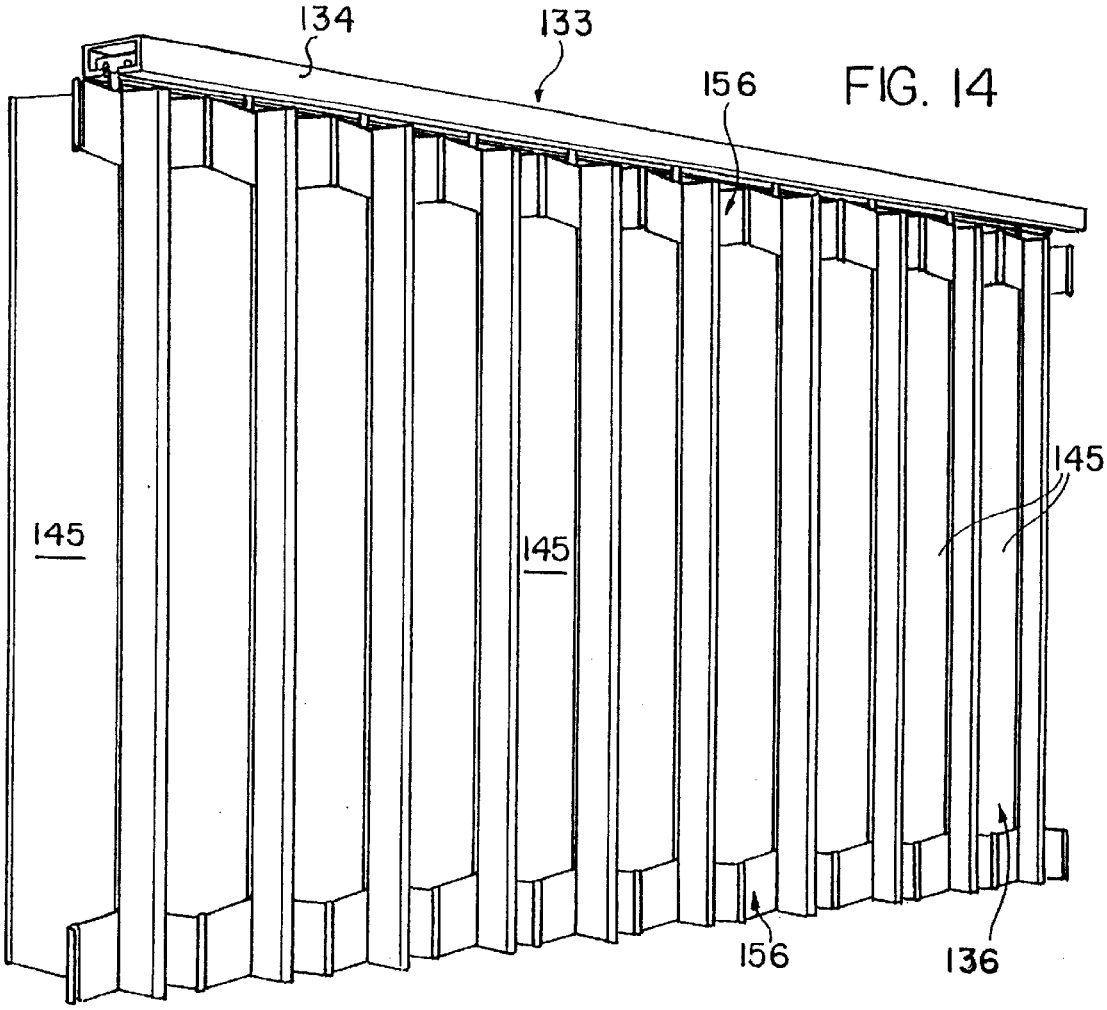
FIG. 14 is a perspective view of a vertical slat blind window cover system in which the slats are mounted at spaced apart positions along one or more (for example, (top and bottom) folding multiple-hinge spacers comprising ribbed stabilizer hinge members.
Figure 15:
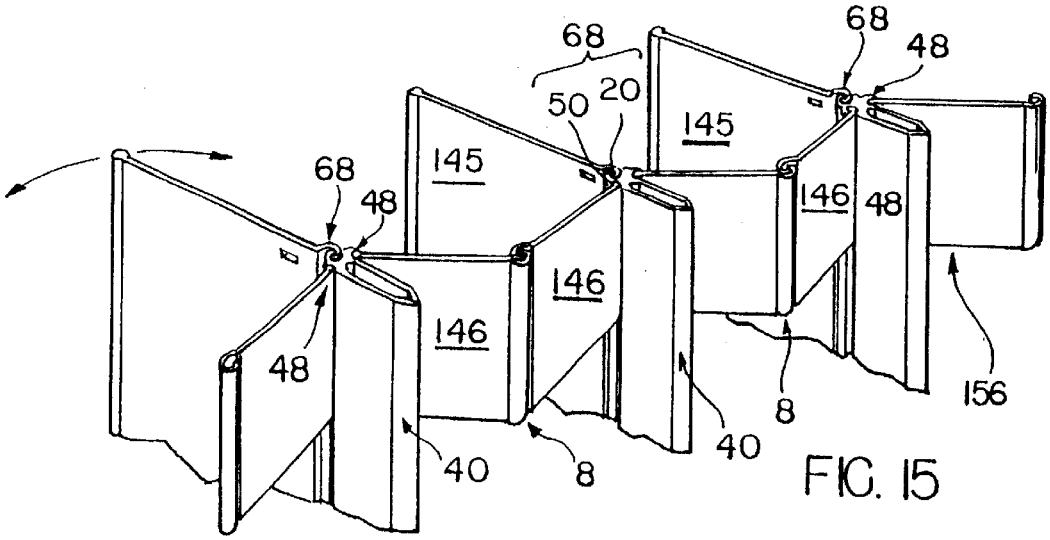
FIG. 15 is an enlarged partial, perspective view of the slat blind of FIG. 14, illustrating the hinged spacers.

FIGS. 14 and 15 depict a vertical slat blind window cover system 133 comprising a vertical slat blind 136 formed of slats 145 which are joined by hinged spacer assemblies 156. Illustratively, the spacer assemblies 156 are mounted at the top and bottom of the blind. The system 133 uses hinge members 10, 20, 30 and 40 for two functions: first, to pivotally mount the slats 145 which comprise the blind 136 and, second, to form the hinged spacer assemblies 156, which maintain the alignment and spacing of the slats 145. The ribbed stabilizer hinge member 40, FIG. 4, is used for both functions. Specifically, and regarding the first function, the slats 145 are similar to slats 15, and incorporate hinge member 20 along one edge which is captured by socket 47 of hinge member 50 of associated ribbed stabilizer hinge member 40, thereby pivotally mounting the slats 145 to the members 40 via hinges 68. See FIGS. 15–19.

Regarding the second function, the hinged spacer assembly 156 is pivotally mounted to (actually incorporates) the elongated ribbed stabilizer hinge member 40. Because the slat hinge members 20 typically extend top to bottom along the elongated vertical length of the slats 145 and are adapted for receiving socket 47 of hinge members 40, one or more (preferably at least two) of the relatively short spacer assemblies 156 can be mounted anywhere along the vertical length of the slats, for example, at the top, bottom and/or intermediate the top and bottom. Preferably, spacer assemblies 156 are mounted along both the top and the bottom of the slat blind 136. Referring especially to FIGS. 15, 18 and 19, each spacer assembly 156 comprises a pair of slat-like spacers 146 which have approximately one-half the horizontal width of the slats 145, and are joined together forming hinges 8 between adjacent members 40. The right spacer 146 of the illustrated hinged pair comprises hinge member/head 33 along the right edge and small hinge member 20 along the left edge. Left spacer 146 of the pair comprises large hinge member 10 along the right edge and head 33 along the left edge. Hinge member 20 is captured by hinge member 10 to form hinge 8, and the heads 33 are captured in the side sockets 49 of stabilizer members 40 along the right and left sides of the hinged pair, forming hinges 48. In short, the spacer assemblies 156 comprise the ribbed stabilizer hinge members 40, which are part of the slat blind 136, and are joined to one another by the hinged spacer pairs 146—146.

As shown in FIGS. 16 and 17, the hinge 68 mounting arrangement of the slats 145 and members 40 permits the slats 145 to pivot approximately 180° for close-packing (FIG. 19) and unfolding (FIG. 18). Referring to FIGS. 18 and 19, the spacer assembly's hinges 8 and 48 (as well as hinges 68) permit full unfolding (blind closed), FIG. 18, in the manner of FIG. 7, and close packing (blind open), FIG. 19, in the manner of FIG. 8.

FIGS. 20–23 depict the use of spacer retainers 191 and retainer caps 195 to position and retain the slats 145, spacer assemblies 156 and hinge members 40. The spacer retainers 191 are rivet members having a flat head 192 on one end and an arrow head 193 on the opposite end for insertion into mating holes 194 in the wall between the sockets 49, just beneath each spacer assembly 156. See FIG. 21. The retainer caps 195 comprise vertical and horizontal members 196 and 197 forming an L. See FIG. 23. The vertical member 196 has tabs 198 on the opposite edges which mount in corresponding slots 199 formed in opposite sides of the elongated body 41 of member 40, near the top end thereof. The horizontal or top member 197 has a circular end 192 which has the shape of hinge member 50, and retains the slats such as 145 and 146 in the head 45 of the member 40.

d. Use of Ribbed Stabilizer Hinges in Dual Blind Systems (FIGS. 24–44)

i. Cover Systems Comprising Combined Vertical Slat Blind and Tape-Supported Vertical Pleated Blind (FIGS. 24–30)

Figure 24:
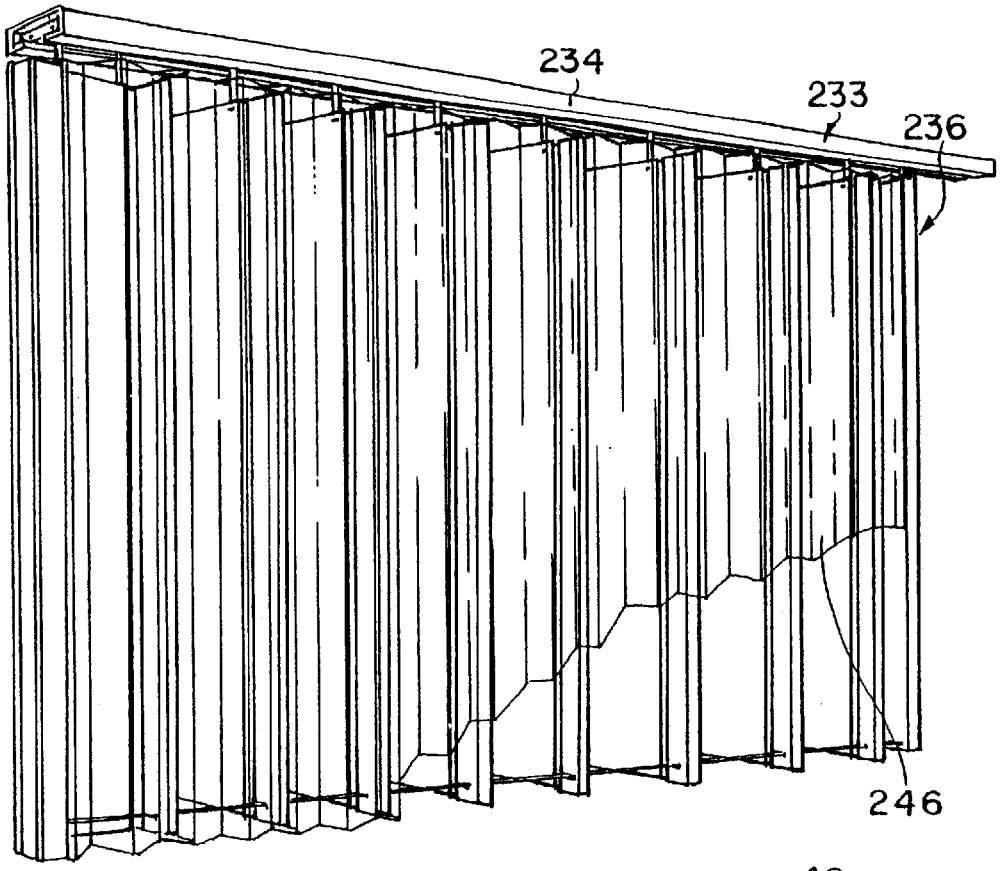
FIG. 24 is a perspective view of a dual vertical blind (slat blind and pleated blind) window cover system in which the slats are mounted to the pleated blind by ribbed stabilizer hinge members.
Figure 25:
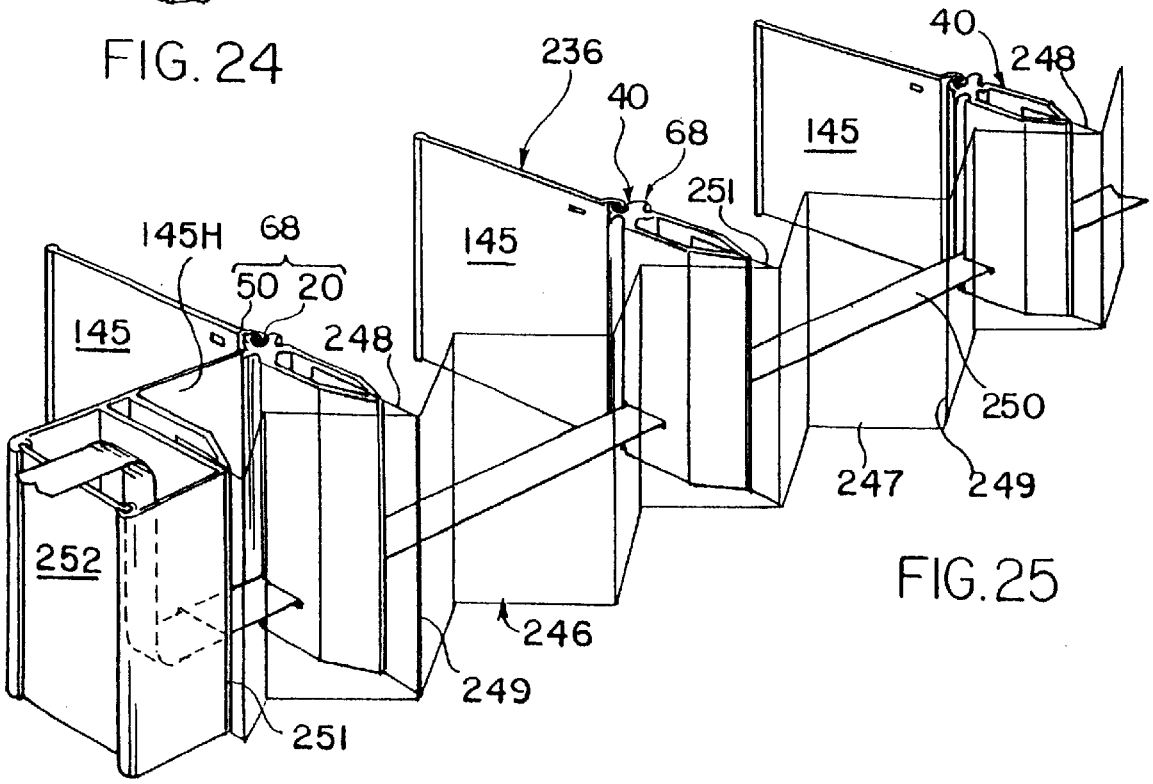
FIG. 25 is an enlarged partial, perspective view of the cover of FIG. 24, illustrating the cooperating joinder of the vertical slat blind to the vertical pleated blind by the ribbed stabilizer hinge members.
Figure 26:
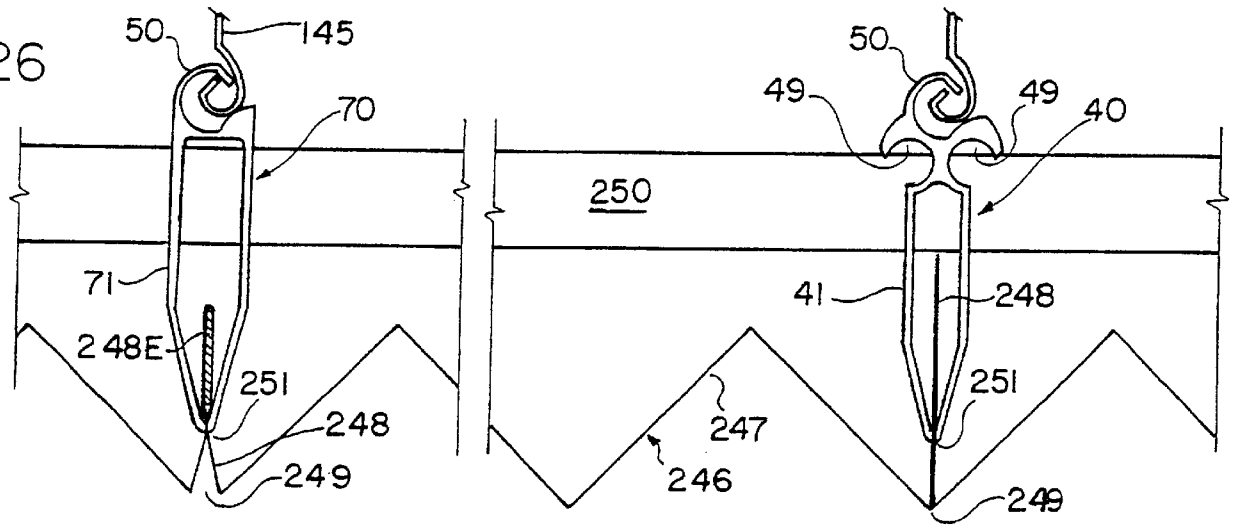
Figure 31:
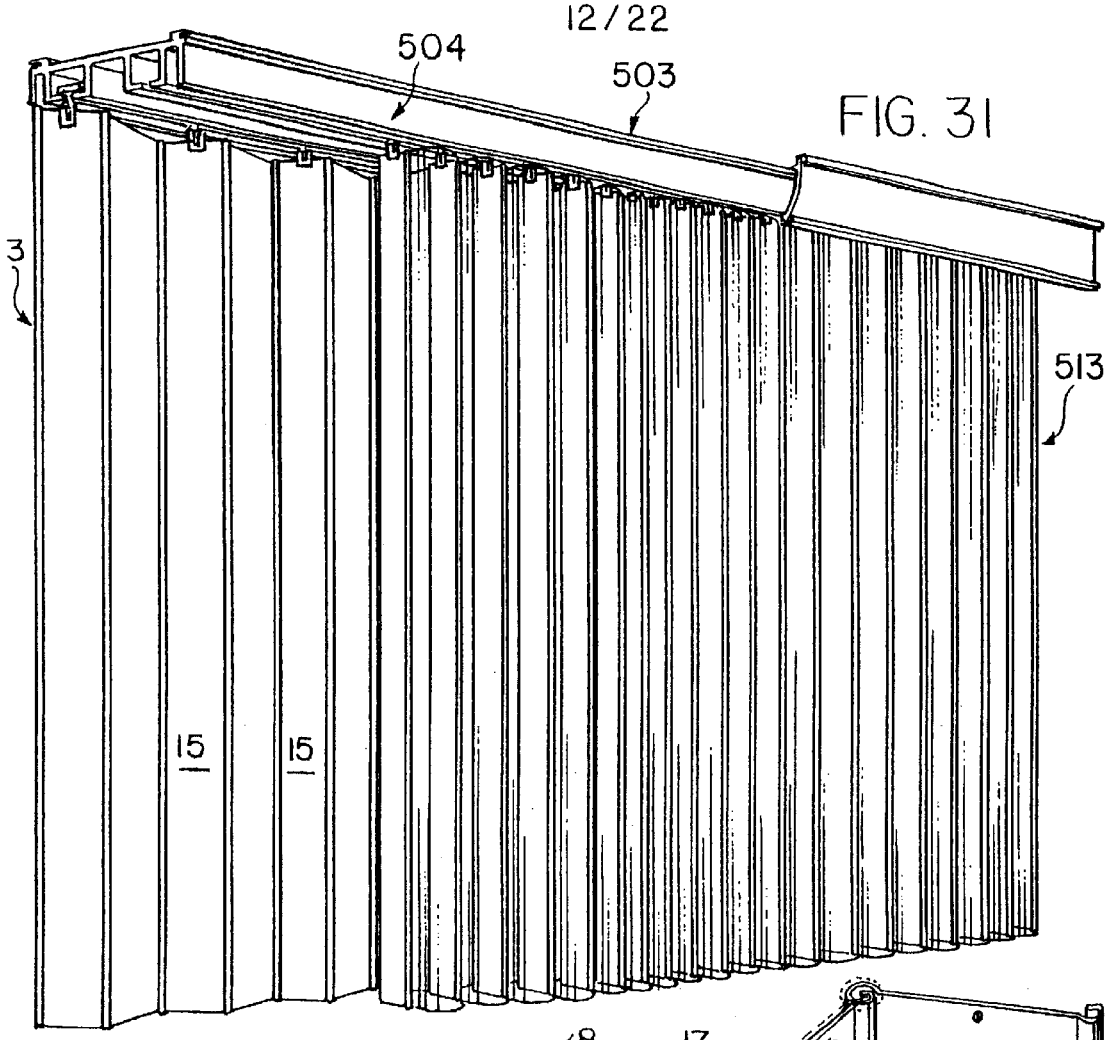
FIG. 31 is a perspective view of a dual vertical blind cover system which comprises independently hung blinds: illustratively, a vertical slat blind of the type shown in FIG. 5 and a vertical roll pleat blind which includes vertical slat-like stiffeners.

FIGS. 24–26 depict an application of the hinge member 40 to form a dual blind window cover system 233 comprising a vertical slat blind 236 and a vertical pleated blind 246, which are supported by traverse track 234. The slat blind 236, which is similar to the same as the slat blind 136 of FIG. 14, comprises slats 145 mounted to the hinge members 40 by hinges 68. As is perhaps shown most clearly in FIG. 26, the vertical pleated blind 246 may comprise conventional pleated material 247 having fastener members (fasteners) in the form of longitudinal ribs or extensions 248 which extend inward from selected ones of the outer pleats or folds 249. Alternatively, the ribs 248 can include enlarged end sections 248E, FIG. 26, extending inward from the outer pleats 249. The housings 41 have longitudinal slits 251 formed along the tips thereof for capturing the ribs 248 and/or the enlarged fastener ends 248E of the ribs and mounting the pleated blind 246 to the members 40. To decrease drawing figures, both plain ribs 248 and ribs having enlarged end sections 248E are depicted in FIG. 26. However, those of usual skill in the art will understand that typically one or the other type of rib will be used in a given blind. By way of example, the width of the slats 145 and the pleats is such that the ribbed stabilizer hinge members 40 and slats 145 are mounted to alternate (every other) front pleat 249.

Note, in the illustrated embodiment, the sockets 49 are not used. Because of this, FIG. 26 also illustrates an alternative ribbed stabilizer hinge member 70, comprising a housing 71 which is similar to the housing 41 of member 40, except that the head section comprises hinge member 50 without sockets 49. Those of usual skill in the art will understand that typically one or the other of the different types of ribbed stabilizer hinge members will be used in such a blind. Also, in this and the other embodiments, the members 40, 70 (also 80, 90, etc.) can be made of from a number of materials, but plastic is preferred for its light weight and flexibility.

A control tape 250 is routed through slits in the housings 41 and/or 71, then vertically through end housing 252, FIG. 25, to which the end of the material 247 is attached. The tape 250 is the type disclosed in U.S. patent application Ser. No. 07/934,989, filed Aug. 25, 1992, now U.S. Pat. No. 5,301,733, issued Apr. 12, 1994, which patent is hereby incorporated by reference. As shown in FIG. 25, conveniently, the housing 252 can be mounted to or integrally include a preferably fixed, slat-like member 145H which extends to or is captured by the socket 49 of adjacent, end stabilizer member 40. The side of the end housing 252 adjacent the blinds has an integral structure which approximates one-half of body 41, and includes a slit 251 for holding the end of the material 247.

The tape 250 is operated as described in the referenced, incorporated '733 patent, causing the vertically pleated blind 246 and the attached vertical slat blind 236 to open and close in unison. The tape 250 maintains the vertical alignment and the spacing of the pleated material 247, preventing the material from blowing or undulating and maintaining uniform spacing between pleats. In turn, the tape-controlled pleated material 247 maintains the alignment and spacing of the slats 145 of the vertical slat blind 236.

Figure 28:
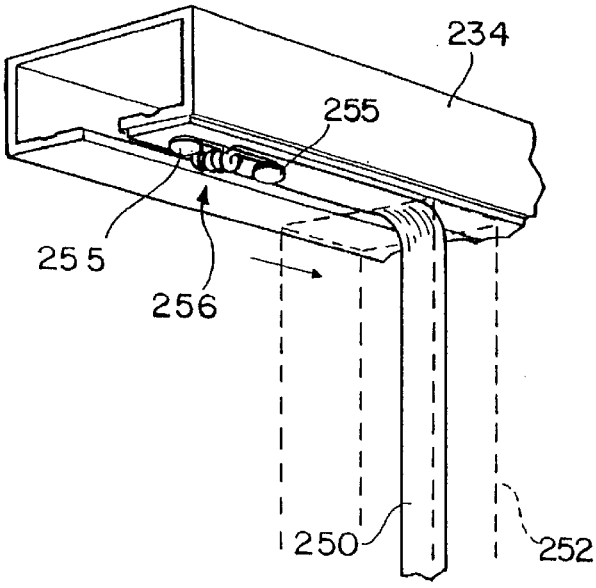
FIGS. 28 and 29 depict the spring of FIG. 27 supporting an associated tape in a blind (partially) open condition and a blind closed condition, respectively.
Figure 29:
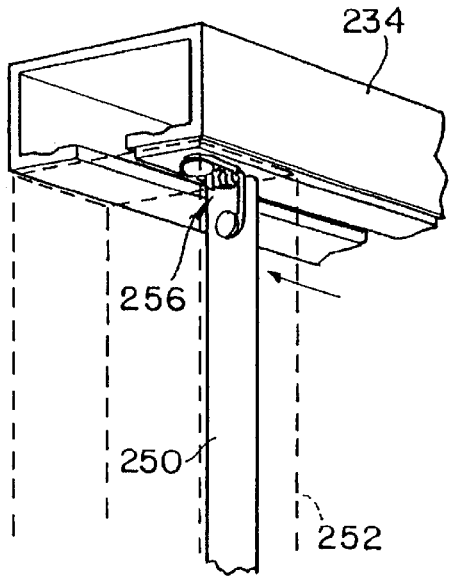
Figure 27:
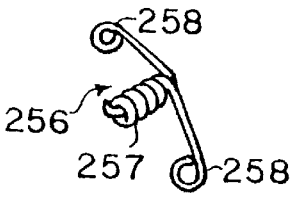
FIG. 27 depicts a spring suitable for mounting a blind support tape to a track.

FIGS. 27–29 depict a spring 256 which can be used to join the end(s) of the tape 250 to a supporting traverse track such as 234. For example, an eyelet 258 in one end of the spring receives a screw or rivet 255 which secures the spring to the underside of the track housing 234, and similarly the end of the tape is mounted to the opposite end of the spring via a second eyelet 258. Coil 257 of spring 256 is wound so that the spring is biased in the open or flat orientation shown in FIGS. 27 and 28, causing the tape 250 to lie flat along the underside of the track housing when the associated blind is open, or partially so. However, as shown in FIG. 29, when the blind is closed, that is, extended to the left end of the track, the spring 256 is pivoted to an approximately 90° angled orientation, and locks the tape and the blind in the closed condition. The biasing action of the spring 256 is easily overcome when the blind is opened, that is, moved to the right, and the spring assumes the flat orientation shown in FIG. 28.

The blind or cover 246 (also covers such as 276, 296) preferably uses a folding fabric 247 (277, 297) having a high degree of light transmission and a high degree of light diffusion. The use of a lightweight fabric is preferred for such covers, among other reasons, because it permits the cover to be attached to an existing venetian blind unit without the need to reinforce the blind to receive the cover. The cover such as 246 or 276 may comprise a series of equally spaced pleats or folds, which may have a spacing corresponding to a whole multiple of the spacing between slats. This prevents the formation of moire effects between slats and pleats. One example of a suitable lightweight, single-pleated fabric drape material 247 having a high degree of light transmission combined with a high degree of light diffusion is used in the RIDEAU™ drape.

Using fabric having a high degree of light transmission, covers such as 233 provide complete privacy when the blind 246 is closed along the window or opening and the slats of blind 236 are pivoted closed. When the folding blind 246 is in the closed condition along the window or opening, but the slats of blind 236 are fully open, as shown in FIG. 25, the cover 336 provides privacy with illumination. Also, using the wand 9, the blind 236 (the slats thereof) can be pivoted clockwise or counterclockwise about the vertical slat axes, to further control the angle of illumination and viewing. The amount of privacy and the amount of illumination also depend upon the type and thickness of material used in the blind 246. Finally, of course, when the cover 233 is in the fully open condition, with the slats 145 of blind 236 and the pleats of blind 246 packed together, maximum illumination and minimum privacy are provided.

Figure 30:
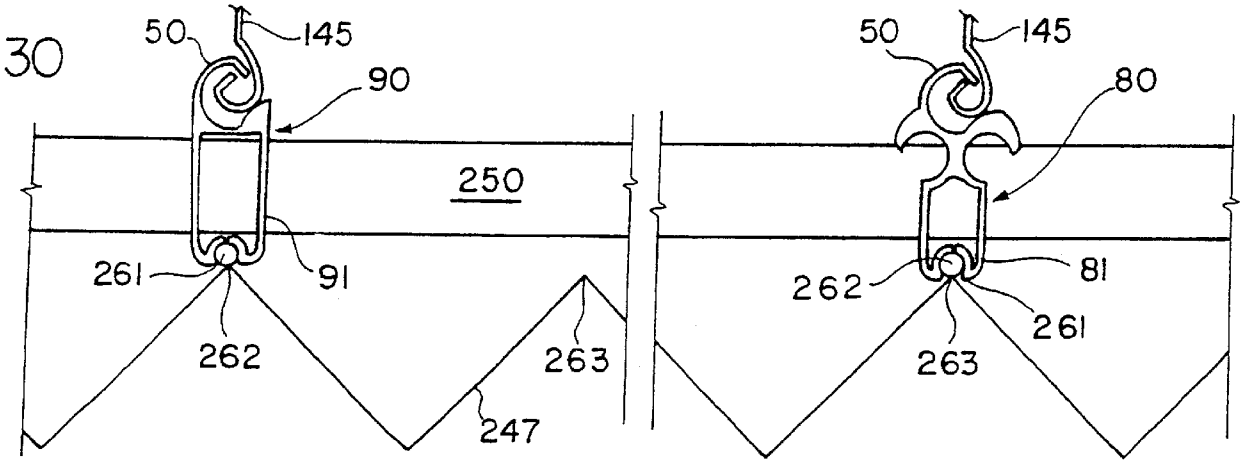
FIGS. 26 and 30 are partial, horizontal sectional views of the dual blind system of FIG. 24 and an alternative dual blind system, respectively.

FIG. 30 depicts an arrangement similar to those of FIGS. 24–26, but in which the elongated stabilizer member or housing 40, 70 is replaced by a generally rectangular but relatively shorter ribbed stabilizer hinge member 80, 90. Each of bodies 81 and 91 of hinge members 80 and 90 comprises a flat front side which forms a longitudinal (vertical) channel 261 of generally circular cross-section. The channel 261 receives a molded elongated bead 262 in a snap-fit arrangement. The pleated material 247 can be attached to the channel 261 of the stabilizer member 260 by positioning the beads 262 against the front side of the rear pleats 263, then pressing the beads and pleat material into channels 261. Alternatively, the beads 262 can be formed as an integral part of the pleated material 247, typically along the rear pleats 263.

ii. Vertical Slat Blind and Separate Vertical Roll-pleated Blind with Stabilizer/Stiffener (FIGS. 31–38)

Figure 32:
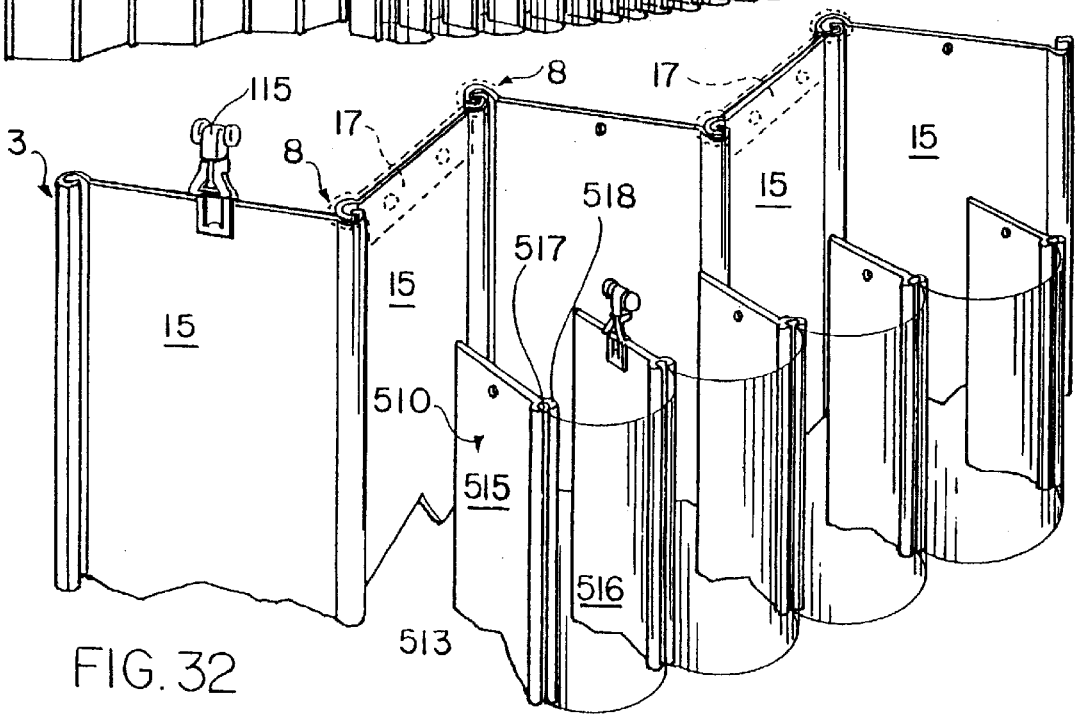
FIG. 32 is an enlarged partial, perspective view of the blind of FIG. 31, illustrating the independent mounting of the two blinds.
Figure 33:
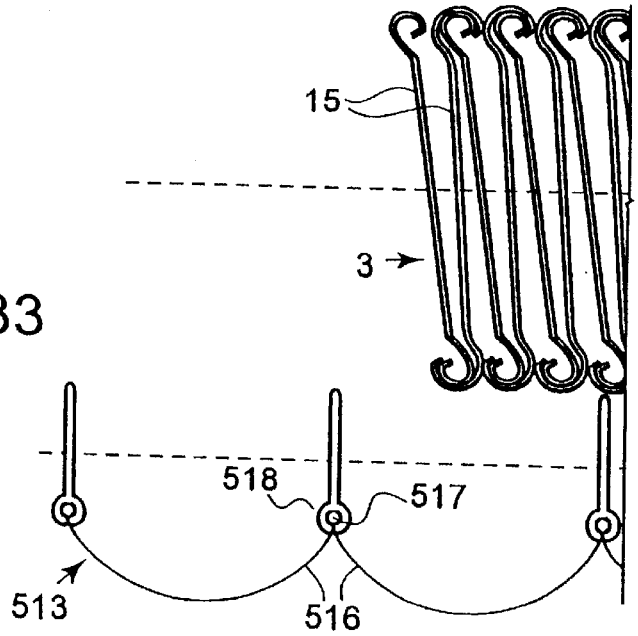
FIGS. 33 and 34 are horizontal sectional views of a section of the slat blind array depicted in FIGS. 31 and 32, showing respectively the slat blind open (slats folded or close-packed) condition, FIG. 33, and the slat blind closed (slats unfolded) condition, FIG. 34, and the independent opening and closing operation of the vertical roll blind.
Figure 34:
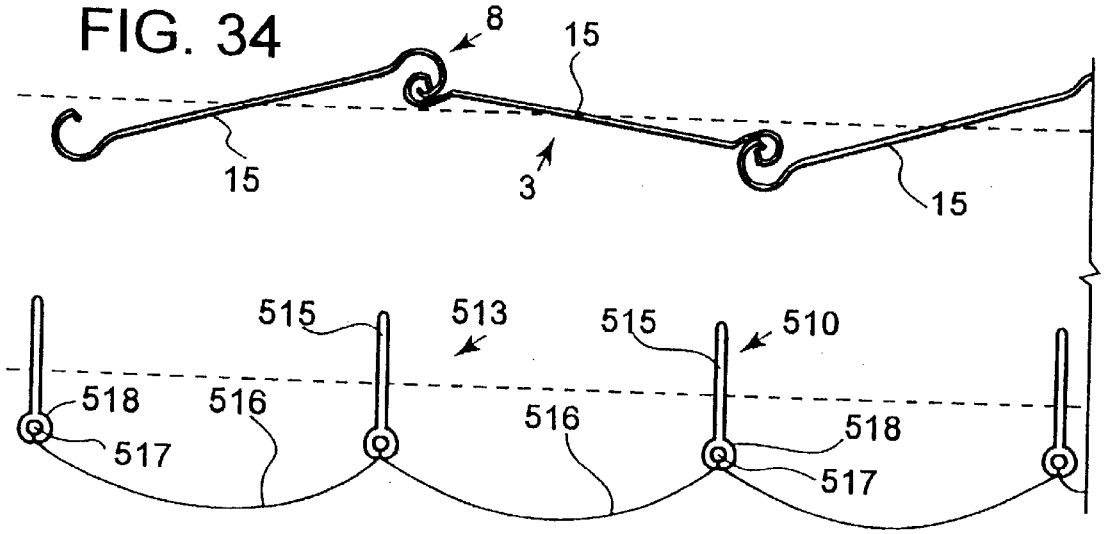
Figure 35:
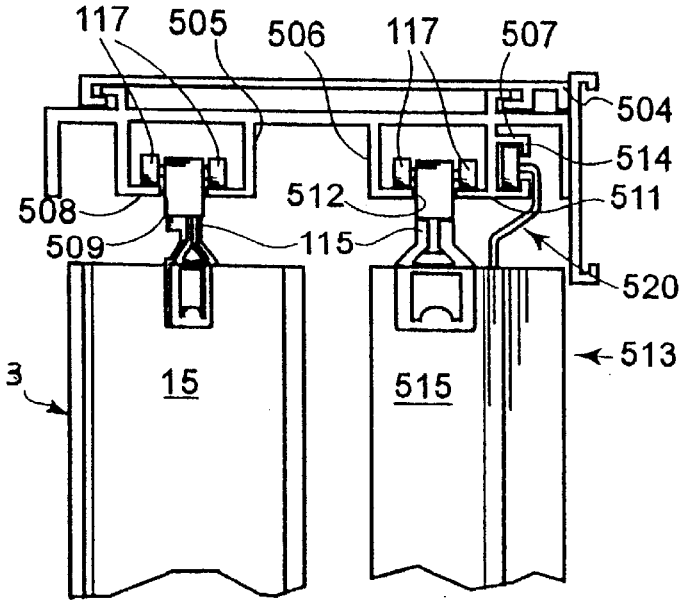
FIG. 35 is a partial, vertical sectional view of the cover system of FIG. 31, depicting the hanging of the two blinds by independent hangers, carriers or trolleys.

FIGS. 31–38 illustrate an alternative dual blind cover system 503, in which the vertical pleated blind 246, FIG. 24, is replaced by a vertical pleated blind 513 which is separate from the slat blind, illustratively blind 3. Preferably the blind 513 comprises a sheer fabric formed in vertical rolls 516 and an associated fabric stiffener formed of slats 515. Specifically, and referring initially to FIGS. 31, 32 and 35, the dual blind system 503 comprises a track assembly 504 which includes three parallel tracks 505, 506, 507, FIG. 35, a double-end hinge panel/slat blind 3 which is captured within track 505 for traversal therein, and the vertical pleated blind 513 which is captured within track 506 for traversal therein. The hinged slat blind 3 is as described previously, for example, relative to FIG. 5 and, when closed, provides complete, opaque visual security. Illustratively, as shown in FIGS. 32 and 35, wheeled carriers 115 are attached to the top of alternating slats 15 of blind 3 and 515 of blind 513, and the hanger wheels 117 are captured for traversing movement within tracks 505 and 506. The tracks 505–507 comprise elongated box-like structures of generally rectangular cross-section. Tracks 505 and 506 have longitudinal slots 509 and 512 along their respective bottom walls 508 and 511 such that the carriers 115 depend through the slot and the spaced-apart carrier wheels 117 are supported by the wall on each side of the slot. Track 507 is formed along the front wall of track 506 and has a longitudinal slot 514 along the front wall thereof for capturing the stabilizer devices described below.

As shown in FIGS. 32–34, the vertical roll pleated blind 513 preferably comprises a sheer fabric of vertical roll panels 516 having elongated, vertically oriented beads 517 molded or attached thereto at the pleats. The cover includes an array 510 of fabric stiffener slats 515. The beads 517 are captured in the slotted vertical clamps 518 formed or attached along one vertical edge of the bodies of the fabric-stiffener slats 515. The stiffener slats 515 may comprise material which is similar to that of the panels or slats 15, but the stiffener slats are shorter, front to back. The stiffener slats 515 mount the carriers 115 (only one carrier is shown, for simplicity), impart rigidity to the vertical roll pleats, and, as discussed below, in conjunction with stabilizer members 520, etc., prevent tilting of the slats front-to-back and side-to-side, and maintain even top-to-bottom spacing between adjacent slats 515 and between adjacent fabric pleats, and maintain the spacing between the slat blind and the vertical pleated/rolled blind.

FIGS. 33 and 34 illustrate the dual blind 503 in two of several combinations of positions for the vertical slat and vertical pleated blinds. In FIG. 33, the vertical slat blind 3 is open, with the hinged slats or panels 15 in the close-pack position, and the vertical pleat blind 513 is partially open. In FIG. 34, both the vertical slat blind 3 and the vertical pleat blind 513 are closed. The use of material such as fabric rolls 516 in blind 513 provides an attractive appearance, in addition to illumination and privacy control. When the slat blind 3 is open, vertical pleated/roll blind 513 controls the combination of illumination through the blind system and privacy, depending upon the choice of fabric, from transparent or near-transparent to opaque.

Figure 37:
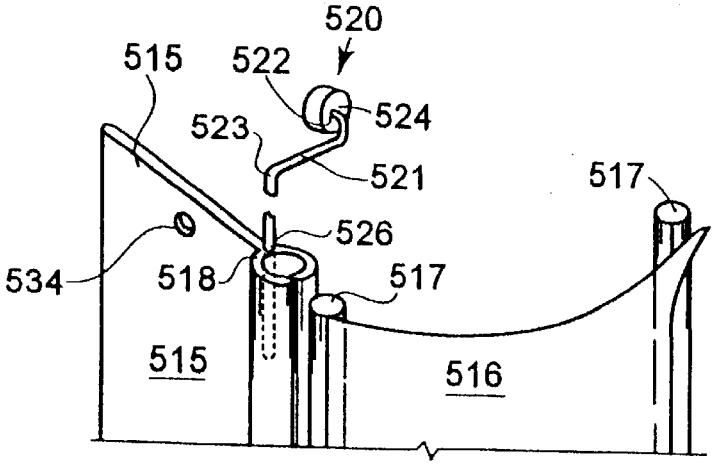

Preferably, the vertical blind 513 includes a plurality of stabilizer or stiffener devices/members which maintain spacing and impart rigidity to the vertical slats 515 and the vertical pleats 516. Referring to FIGS. 35 and 37, in one embodiment, a non-coil stabilizer device 520 is used, which comprises a generally c-shaped arm member 521 having a downward-extending elongated, generally vertical leg 523. Upper end 522 of the member 521 forms an axle for mounting wheel 524, which is rotatably captured within track 507, FIG. 35, for traversal along the track. The member 521 is oriented at an angle to the vertical leg 523 thereof such that the member defines a generally question mark-shaped configuration when viewed from the side (FIG. 35) or the top (FIG. 37). The bottom end of device 520, leg 523, is attached to the associated slat 515, for example, by a friction fit in a generally vertical hole 526 formed in or adjacent the front edge of the slat 515. As shown in FIG. 35, track 507 comprises a box-like member of generally rectangular cross-section extending along the front of track 506 and has a slot 514 in its front wall through which the shaft 523 extends.

Figure 36:
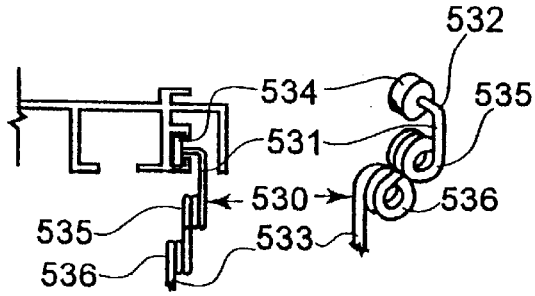
FIGS. 36–38 depict alternative stiffeners for the blind of FIGS. 31–35.

Referring to FIG. 36, an alternative spring stabilizer 530 can be used which comprises, for example, a member 531 which includes two adjacent coils 535 and 536, and wheel 534 which is mounted for rotation on upper shaft 532. The shaft 532 extends through the elongated slot 514 along the front of track 507 and the wheel 534 is rotatably captured within that track so that the wheel can traverse along the track. Stiffener device 530 is mounted to slat 510 via bottom leg 533, which is captured within hole 526, FIG. 37.

Figure 38:
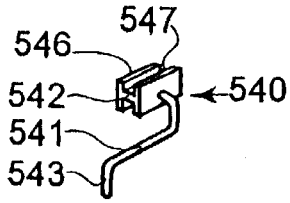

FIG. 38 illustrates yet a third stabilizer 540, one which has a body member 541 similar to member 521, and includes a slide member which is captured within the track 507 for sliding movement along the track. The slide is of generally I cross-section and the middle member 542 thereof extends through the slot 514, with the vertical members 546 and 547 captured inside and outside the track, respectively. Again, the bottom leg, in this case leg 543, is captured within hole 526, thereby mounting the stabilizer device to the slat 515.

iii. Combined Vertical Slat Blind and Vertical Roll-Pleated Blind (FIGS. 39–43)

(a). Tape-Supported Vertical Roll or Pleated Blind (FIGS. 39–41)

Figure 23:
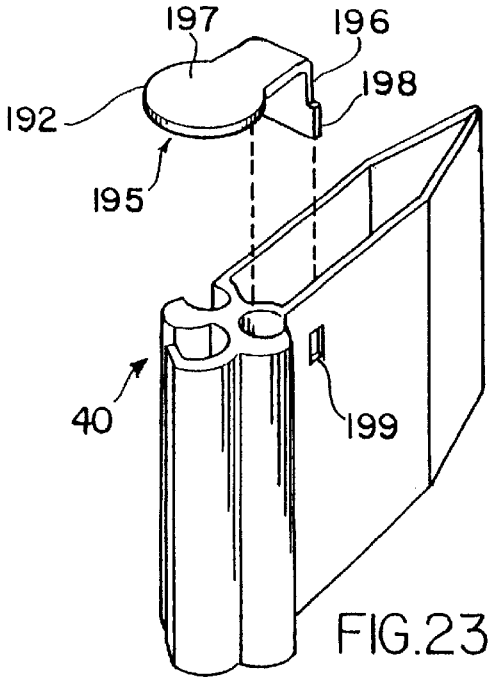

FIGS. 39 and 40 illustrate an alternative tape-supported dual blind window cover system 236, see FIGS. 23, 24, which comprises vertical slat blind 136 and vertical roll pleated blind 276 comprising vertically rolled fabric 277. Here a ribbed stabilizer hinge member 60 is used which is an alternative to hinge member 40, and comprises a relatively short body 61 having a flat front end 62 and a socket 50 formed along the rear edge of the slat. The hinge members 20, which are formed along the front edge of the slats 145 of slat blind 136, are captured by the sockets 50 forming hinges 68. The blind 276 has curved or rolled pleats and for convenience, shall be referenced as having inner roll pleats 278 and outer roll pleats 279. The inner rolled pleats 278 are attached to the front edge 62 of the hinge members 60 by retainers such as pins or rivets 280 which are similar in construction to the retainer pins 191, FIG. 19. End housing 63 functions similar to housing 252, FIG. 25, and comprises a hollow vertically elongated body 64 through which a tape such as 250 is routed to the associated track, a flat front end 65 to which the end pleat 278 is fastened by pin 280, and a laterally inward-extending slat 66 against which the endmost slat 145 folds, when the slats are closed. The slat 66 thereby prevents gaps between the slat blind and the end housing, and so completes the closure and privacy afforded by the closed blind.

FIG. 41 illustrates yet another embodiment of the present invention, an alternative tape-supported dual blind window cover system 286 which comprises vertical slat blind 136 and a vertical roll pleated blind 296. This embodiment uses a ribbed stabilizer hinge member 100 similar to member 40, FIG. 15, except that the short body 101 is preferably rounded at the front 102 and contains a horizontal slot (not shown) for receiving tape 250. The slats 78 of vertical slat blind 77 have hinge members 20 along the front edge which are captured by sockets 50 of the hinge rib stabilizer member 290, forming hinges 68. The blind 296 comprises discrete individual panels 297 of material having elongated vertical beads 298 of generally circular cross-section formed along the opposite longitudinal edges of each panel. The beads 298 are captured by the sockets 49 in the hinge rib stabilizer member 290, forming hinges 48. The individual panels 297 facilitate the use of different colors, for example, alternating panels of different colors or simply blinds of different colors; different materials such as sheer and opaque fabric and plastic; different decoration schemes; and the replacement of damaged sections of the blind.

(b). Vertical Roll or Pleated Blind (FIGS. 42–45)

FIGS. 42–45 illustrate another embodiment of the present invention, an alternative dual blind window cover system 286 which comprises a vertical slat blind 136 and a vertical roll pleated blind 296, which again comprises separate panels 297. The hinge members 20 along opposite edges of the slats 145 are captured by sockets 50 in the rib stabilizer hinge members 290, forming hinges 68 which pivotally mount the slats to the hinge members 100. Note, the hinge rib stabilizer members 100 can be slotted for supporting a tape 250, or non-slotted.

Figure 42:
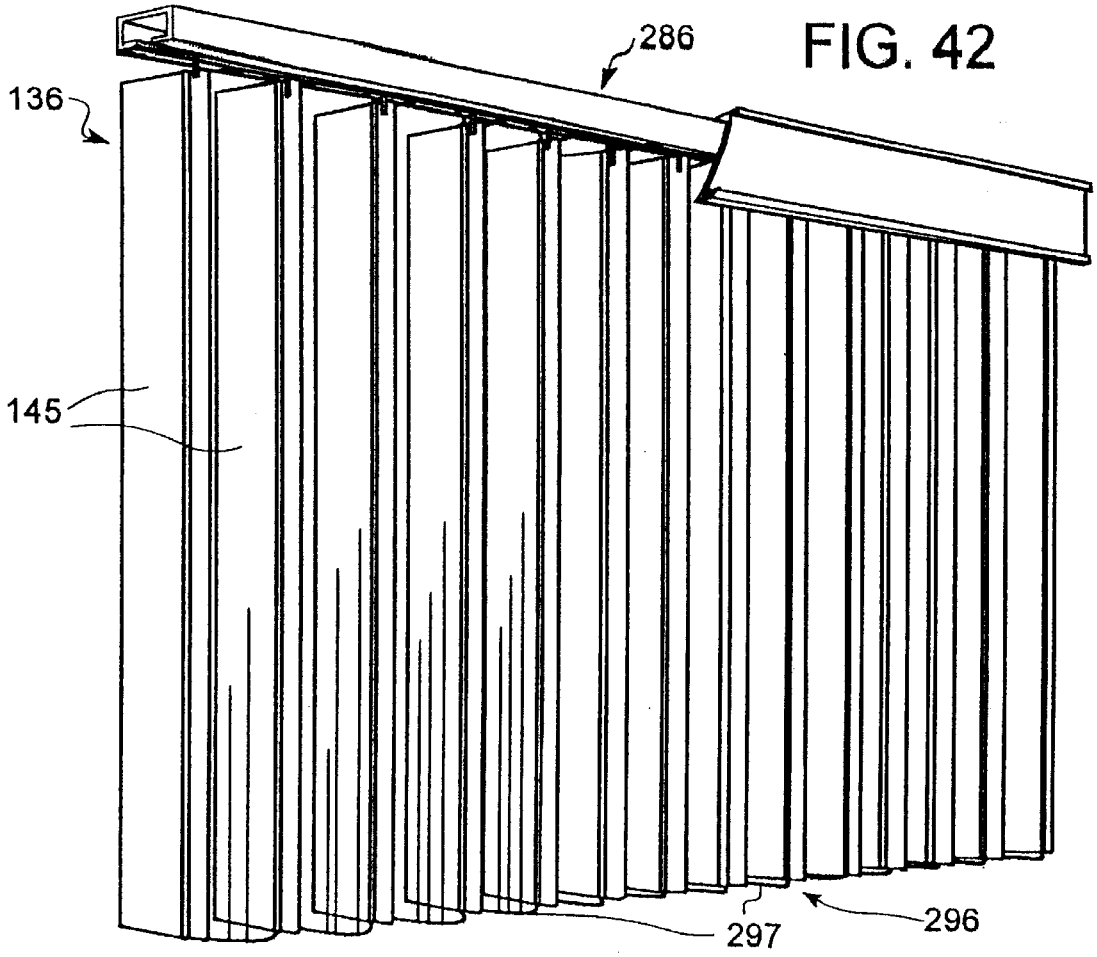
FIG. 42 is a perspective view of yet another dual, vertical slat blind, vertical roll pleated blind window cover system, an embodiment in which the vertical roll blind comprises separate panels mounted along their opposite edges to adjacent ribbed stabilizer hinge members.
Figure 43:
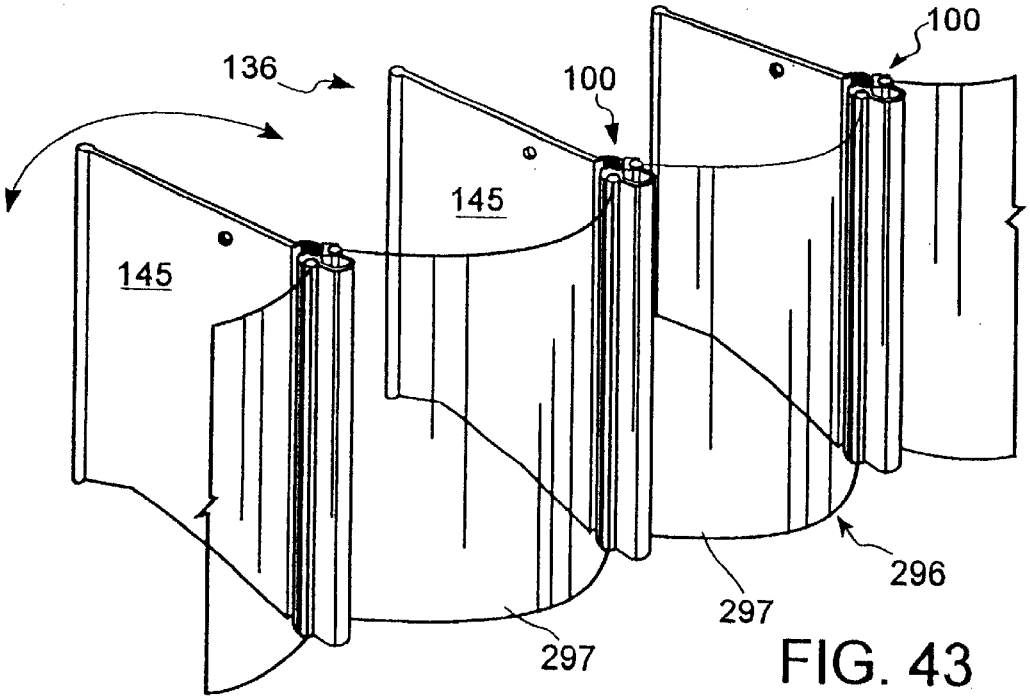
FIG. 43 is an enlarged partial, perspective view of the window cover system of FIG. 42, illustrating the mounting of the slats and panels to the ribbed stabilizer hinge members.

FIG. 43 is a partial perspective view of the window cover system 286 of FIG. 42, illustrating the mounting of the slats 148 of blind 136 and the roll pleats 297 of blind 296 to the rib stabilizer hinge members 100 via the hinges 68 and 48, the same arrangement used in FIG. 41. A partially open condition for the roll pleat blind and a fully closed roll pleat blind condition are depicted, respectively, in FIGS. 44 and 45. The blind system of FIGS. 42–45 is the same as the vertical pleated blind of FIG. 41, except that the blind system of FIGS. 42–45 preferably is stabilized by a stiffener assembly, rather than a tape such as 250, or is used without a stabilizer, as illustrated. Examples of window covers which use stabilizer assemblies are depicted in FIGS. 46–51 (stiffener assembly 300) and in FIGS. 52–57 (stiffener assembly 400). The stiffener assemblies mount the carriers, stabilize the slats and help overcome the resistance of the pleats.

e. Stiffener Assemblies and Dual blinds (FIGS. 46–57)

i. Stiffener Assembly 300 (FIGS. 46–51)

Figure 46:
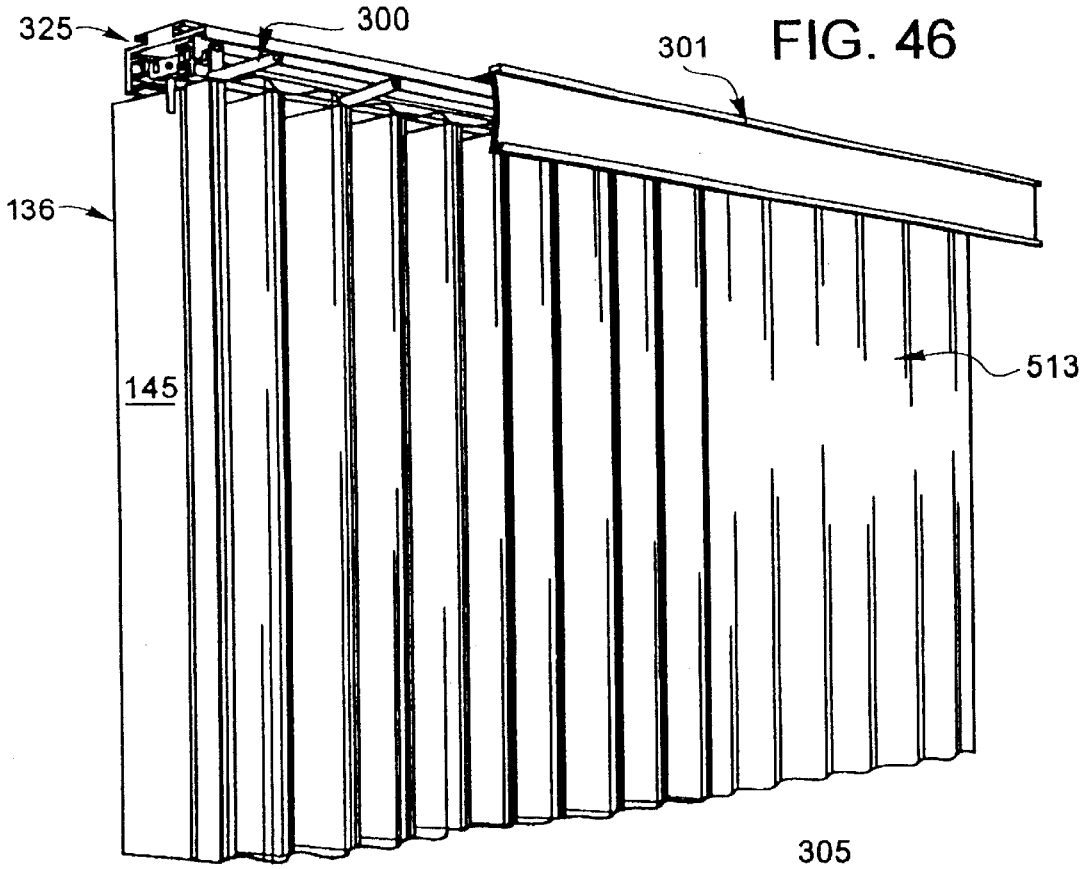
FIG. 46 is a perspective view of a dual, vertical slat blind, vertical roll pleated blind window cover system which incorporates a stiffener assembly.
Figure 47:
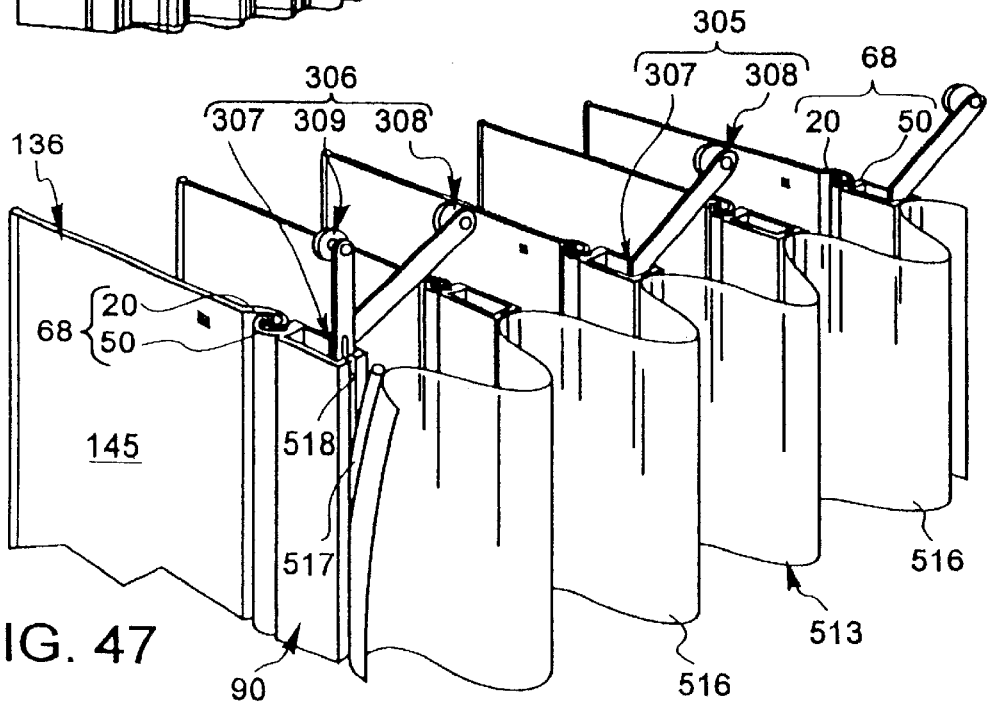
FIG. 47 is an enlarged partial, perspective view of the window cover system of FIG. 46 illustrating the mounting of the slat blinds and roll panels.

FIGS. 46 and 47 are perspective views of a window cover system 301 incorporating a stiffener assembly, here designated 300, which mounts the carriers, stabilizes the slats and helps overcome the resistance of the pleats. The cover system 301 is similar to the covers of FIGS. 30 and 40, with the substitution of stiffener assembly 300 for tape 250. The cover system 301 typically comprises a blind 136 formed of slats 145 and a vertical roll (or vertical pleat) blind such as 513, which can be mounted to ribbed stabilizer hinge members such as 90. Illustratively, the slats 145 are attached via hinges 68 (formed by hinge members 20 and 50). The pleats or rolls 516 of the vertical pleated blind 513 include beads 517 formed or attached along the rear roll pleats, which are captured in the slots or channels 518 along the front edge of the ribbed stabilizer hinge member 90, which also has a hole 311 therein.

Referring to FIGS. 46–51, and in particular to FIGS. 48 and 49, preferably stiffener assembly 300 comprises end stiffener assemblies 306 mounted to the members such as hinge members 90 which are located at the fixed/traversing end(s) of the blind and stiffener assemblies 305 mounted to the hinge members 90 which are intermediate the ends of the blind. Intermediate stiffener assemblies 305 comprise a support or backing member 307 and an angled stiffener member 308. End stiffener members 306 comprise support/mounting member 307, angled stiffener member 308 and vertical stiffener member 309.

Stiffener member 308 comprises an angled body or member formed by a vertical lower leg 312 having a slot or hole 314 therein and an angled upper leg 313 which has a wheel 315 rotatably mounted at the upper end thereof. Typically, the angle Θ between the legs is about 45° to 60°. See FIG. 49. Mounting member 307 has a hole 310 therein, typically a threaded hole for receiving a screw or other fastener 318. Member 309 comprises a vertical leg 319 having an elongated vertical slot 320 at the bottom end and a wheel 321 rotatably mounted at the upper end.

To mount the intermediate assembly 305 to an associated hinge member 60 or other hinge member, the stiffener member 308 is positioned between the support member 307 and the inside surface of the front end of ribbed stabilizer hinge member 90, and the screw 318 is inserted through the holes 311 and 314 and into the threaded hole 310 of support member 307 and tightened. This arrangement is as shown in FIG. 49 and is FIG. 48 without the vertical member 309. Please note, support member 307 is effectively an elongated nut or fastener which receives and stiffens the assembly.

Referring still further to FIGS. 48 and 49 and also to FIG. 50, and as alluded to above, the end stabilizer assembly 306 comprises support member 307, angled stiffener member 308, and vertical stiffener member 309. To mount the end stiffener assembly 306 to an associated hinge member 60, preferably the members 307 and 308 are positioned as described above, vertical stiffener member 309 is positioned between member 308 and the inside end surface of member 90, and the screw 318 is inserted through hole 311, slot 320, hole 314 and into threaded hole 310, and tightened.

An assembly 300 of intermediate and end stiffeners 305, 306 is depicted in FIGS. 49 and 51. The vertical lengths of legs 319 on the one hand and legs 312 plus 313 on the other, are approximately equal, such that the wheels 321 and 315 are positioned at approximately the same vertical height. Associated traverse track 325 comprises two parallel horizontal track sections or tracks 326 and 327. A pair of c-shaped track sections or tracks 328 on the opposite, front and rear inside walls of track 326 rotatably capture the wheels of carriers 335 from which slat 145 is suspended. This permits horizontal traverse of the carriers 335 and blind 136 (and blind 513) along the track. The horizontally spaced stiffener wheels 315 and 321 are rotatably captured by a c-shaped track 327, which extends along one outside longitudinal surface (front surface) of the track 326. Carriers 335 are a conventional design, adapted both for traversing and rotating the associated blinds, and need not be described here.

Referring to FIG. 49, loosening screw 318 and adjusting the stabilizer assemblies 306 in the vertical direction 331 parallel to member 319, moves/adjusts the ribbed stabilizer hinge members 90 in and out in the horizontal directions 332 transverse to the plane of the cover while similarly adjusting the assemblies 305 in the direction 333 parallel to the member 308, adjusts the rib stabilizer hinge member 90 left or right in the horizontal direction 334 parallel to the plane of the cover.

ii. Stiffener Assembly 400 (FIGS. 52–56)

Figure 52:
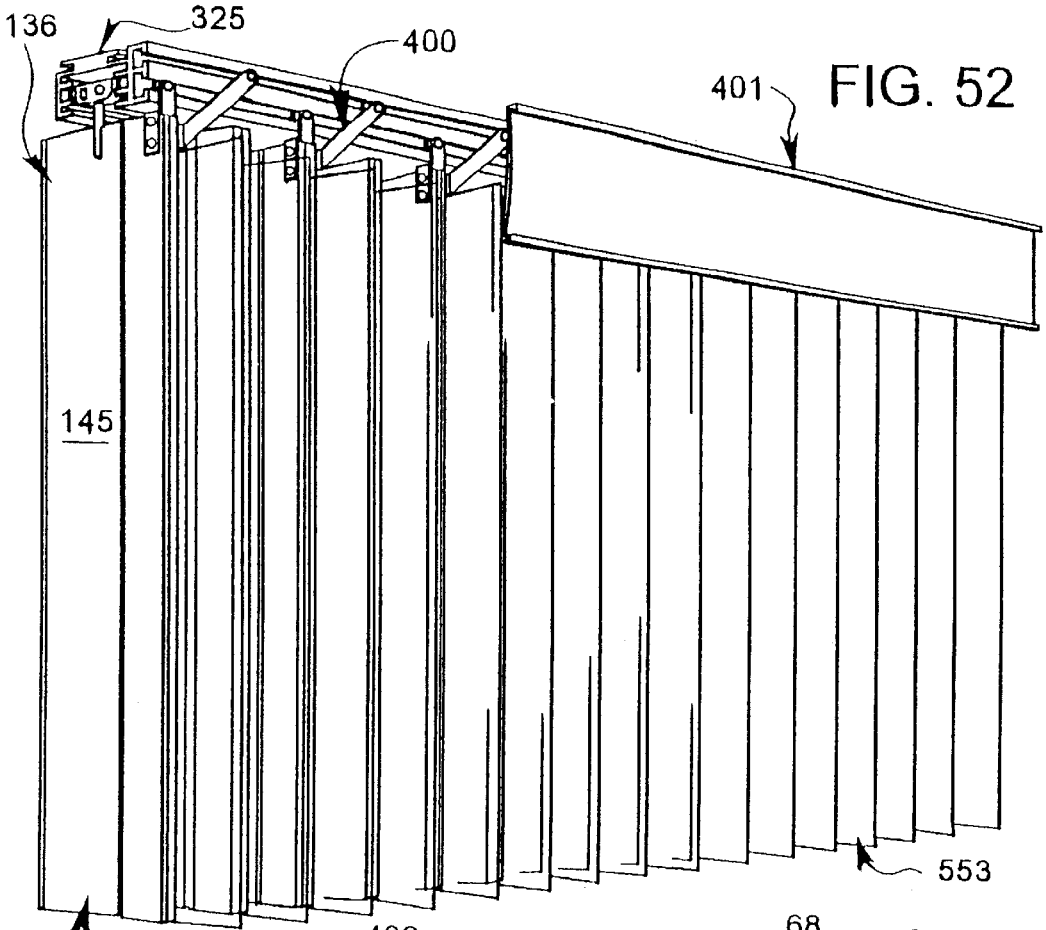
FIG. 52 is a perspective view of a dual blind window cover system which includes an alternative stiffener system, shown in FIGS. 53–57.
Figure 53:
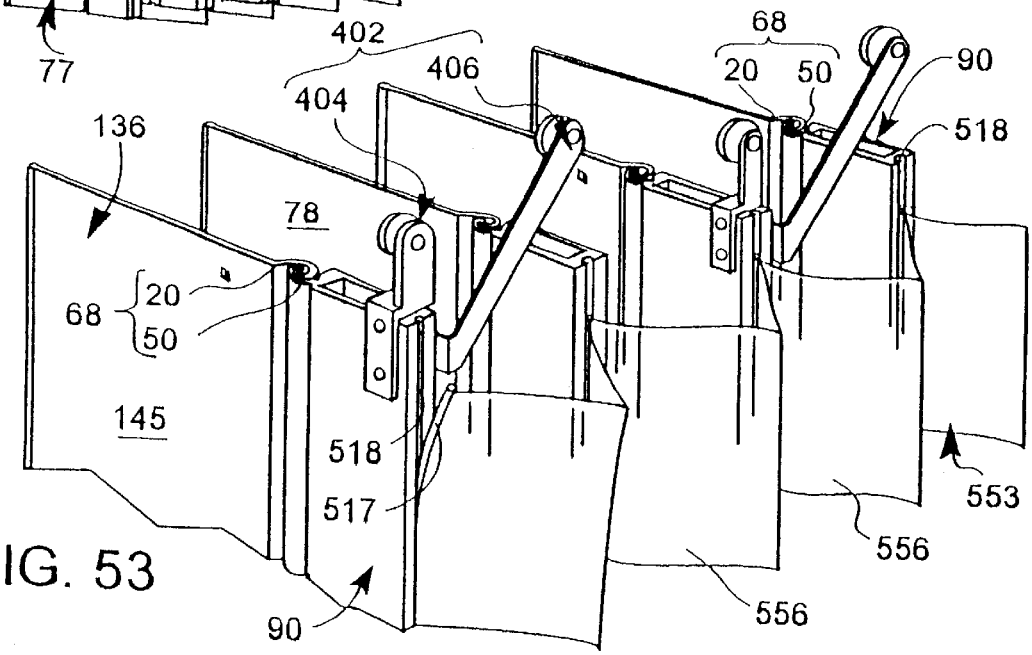
FIG. 53 is an enlarged partial, perspective view of the window cover system of FIG. 52, illustrating the mounting of the slat blinds and pleated blinds.

FIGS. 52 and 53 are perspective views of another window cover system, designated 401, which incorporates yet another stiffener array, designated 400, which mounts the carriers, stabilizes the slats and helps overcome the resistance of the pleats. As described regarding window cover 301, the blind structure of window cover 401 is similar to that of FIG. 40 without the tape 250 and with the addition of the stiffener assembly. The cover 401 typically comprises a blind 136 formed of slats 145 and a vertical pleated blind such as 553, which can be mounted to ribbed stabilizer hinge members such as 90. Illustratively, the slats 145 are attached via hinges 68 (formed by hinge members 20 and 50) and the pleats 556 or rolls of the vertical pleat blind 553 include beads 517 on the back folds which are captured in the slots or channels 518 along the front edge of the ribbed stabilizer hinge member 90. The stiffeners 300 and 400 can be substituted for one another. The different covers shown in FIGS. 46 and 47 (300) and FIGS. 52 and 53 (400) illustrate the wide applicability of the stiffeners. Each stiffener 300 and 400 can be used with both covers, as well as numerous other covers comprising single and plural blinds.

Figure 54:
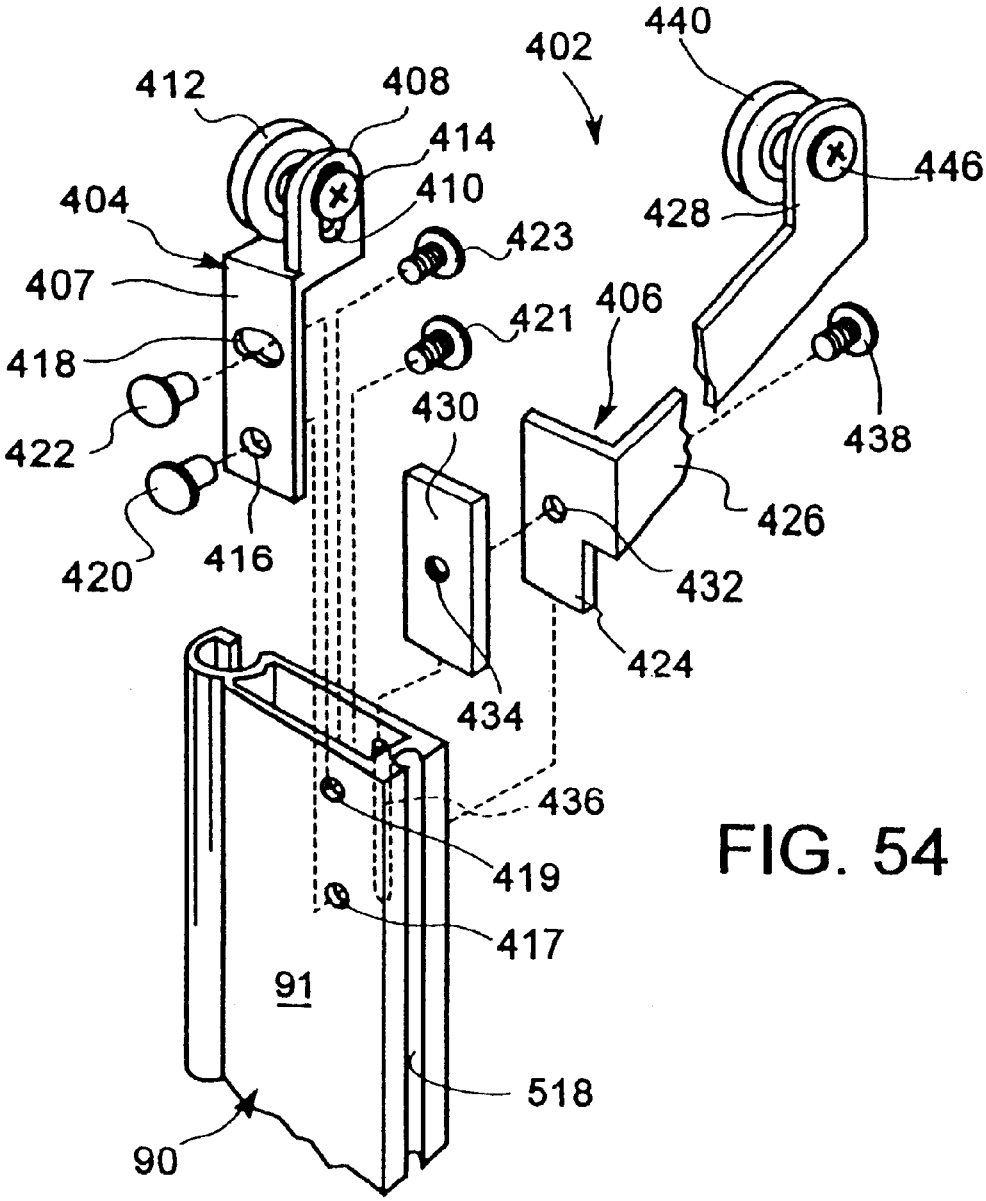
FIG. 54 is an exploded view of one of the stiffener members of FIGS. 52 and 53.
Figure 55:
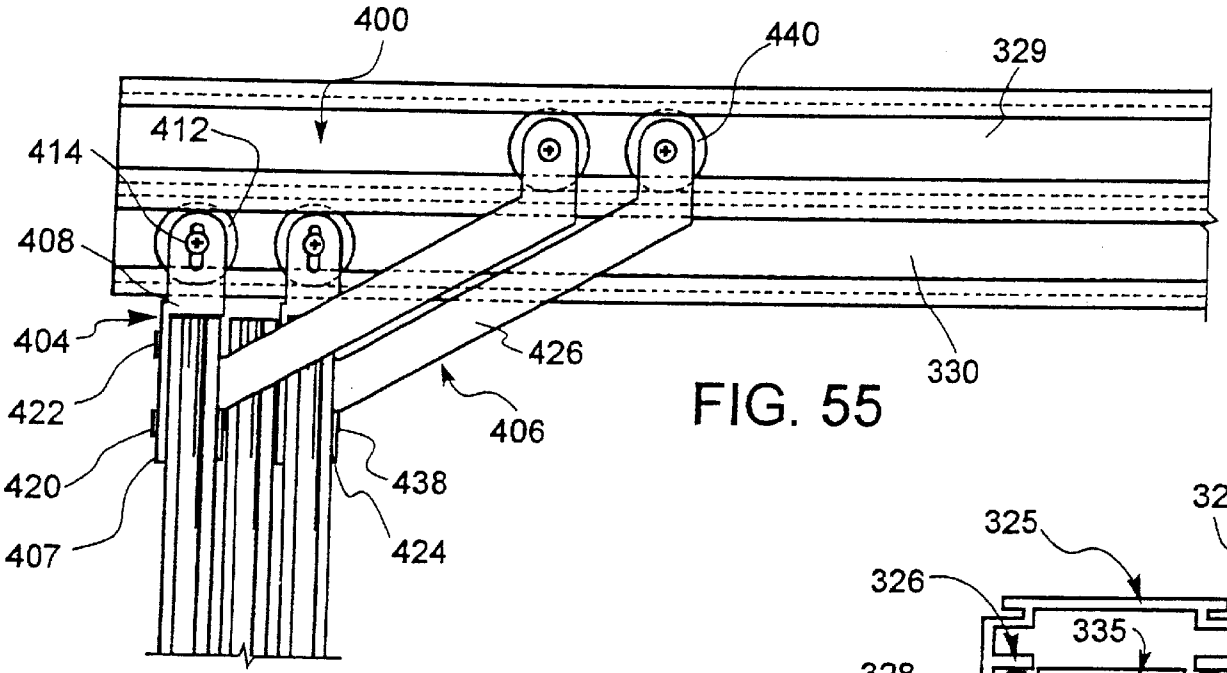
FIG. 55 is a partial vertical elevation view illustrating the close-packing of the second stiffener system applied to a dual blind window cover system.

Referring to FIGS. 52–57, and in particular to FIGS. 54 and 55, preferably the slats 145 of blind 136 are suspended by conventional wheeled carriers 335 and the individual stiffeners 402 of assembly 400 comprise a vertical member 404 and a sideways-angled member 406, both of which are mounted to a ribbed stabilizer hinge member 90. The vertical stiffener member 404 comprises a vertical arm 407 having an upper section 408 in which is formed a vertically elongated slot 410. A wheel 412 is mounted for rotation, for example on a shaft which is affixed to member 408 by screw 414. Vertical arm 407 includes a bottom hole 416 and a vertically spaced-apart, horizontally elongated, upper slot 418 which permit attachment of member 404 to mating holes 417 and 419 in the side of the body 91 of hinge member 90 using fasteners such as screws 420–421 and 422–423. See FIGS. 54 and 57. Slot 418 permits pivotal adjustment of the blinds (members 90 and slat 145) front-to-back, for example, to correct or impart tilt relative to the vertical axis.

The angled stiffener member 406 comprises a relatively short vertical arm 424 and a relatively long angled arm 426 having a short vertical extension 428 at the upper end. Wheel 440 is mounted for rotation, for example, on a shaft which is affixed to member 428 by screw 446. The lower vertical arm 424 has a hole 432 which aligns with threaded hole 434 in support member or backing plate 430 and with vertical slot 436 in the hinge member 90. To attach the angled member 406 to hinge member 90, arm 424 and backing plate 430 are respectively positioned outside and inside the slotted side of the body 91 of member 90 and screw 438 is inserted through the hole 432 and the slot 436 and tightened into the hole 434.

Vertical (up and down) adjustment of stiffener 406 along slot 436 using screw 438 adjusts the stiffener horizontally (left and right). Vertical (up and down) adjustment of stiffener 404 along slot 410 relative to wheel 412 within slot 410 using screw 414 moves (pivots) the bottom of the blinds horizontally in and out generally perpendicular to the plane of the cover. Also, loosening screw 422–423 and pivoting the member 404 left and right along slot 418 about hole/pivot point 416 cocks or pivots the blinds front-to-back (and back-to-front) in the vertical plane.

Figure 57:
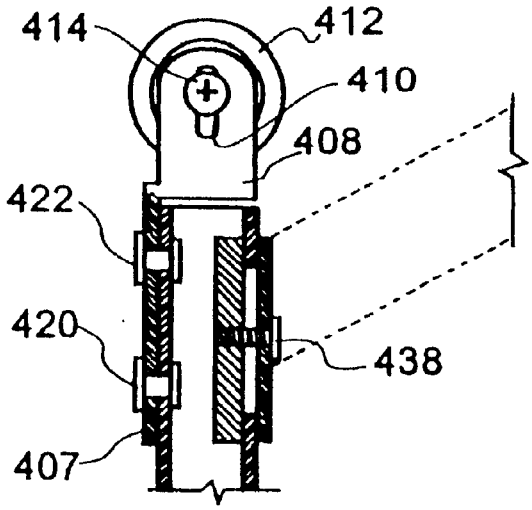
FIG. 57 is a sectional view taken along lines 57—57 in FIG. 56.
Figure 56:
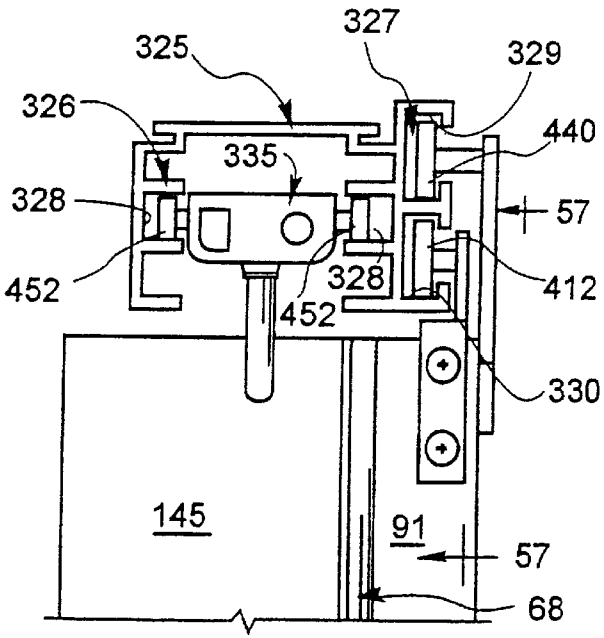
FIG. 56 is an end view of the track of FIGS. 52 and 55, illustrating the capture of the carriers and stiffeners.

Referring to FIGS. 55 and 57 and also to FIG. 56, the relatively short length of member 404 and the relatively longer length of arm 426 and the angled orientation to the vertical of arm 426 position the wheels 440 displaced above and to the right of the wheels 412. Associated traverse track 325 comprises an elongated track housing 326 of generally rectangular cross-section comprising a pair of c-shaped track sections or tracks 328 on the opposite inside walls thereof for rotatably capturing the wheels 452 of the carriers 335 to permit horizontal traverse of the associated carriers 335 and blind(s) along the track. The vertically spaced stiffener wheels 412 and 440 are rotatably captured by c-shaped over and under track sections or tracks 329 and 330 of track 327 which extend along the outside longitudinal front surface of the elongated housing 325.

The above stiffener arrangement stabilizes the blinds in three planes. First, and referring to FIGS. 55 and 56, the two spaced carrier wheels 452 and the two spaced stiffener wheels 412, 440 associated with each carrier 335—slat 145—hinge 68—member 90 assembly provide four spaced-apart support points for the carrier and assembly, and thus suppress pivotal movement of the carrier in the vertical plane transverse to the plane of the blinds. Second, the horizontal spacing and the vertical spacing between the wheels 412 and 440 of each stiffener suppresses pivotal movement of the associated carrier 335 and the assembly in the vertical plane generally parallel to the plane of the blinds. Third, the horizontal spacing between the wheels 412 and 440 of each stiffener 402 and the horizontal displacement of the carrier wheels 452 (along the direction front-to-back) relative to the vertical plane of the wheels 412 and 440 together form a triangular array in the horizontal plane which suppresses pivotal movement of the carrier in the horizontal plane transverse to the plane of the blinds approximately corresponding to the pivot axis of the carrier.

Note, mounting the stiffeners 402 on alternate hinge members 90 (also stiffeners 305, 306, FIG. 49) provides the desired stiffening action in which the tendency of the blinds (slat blind 136 and pleated blind 553) to undulate, tilt and sway is suppressed and the blinds maintain their vertical orientation and pleat-to-pleat and slat-to-slat spacing. Also, the dimensions, offset wheels, angled arms, and alternate positioning of the stiffeners permit positioning the stiffeners 402 in close, overlapping relationship. This close-packing and lack of interference between the members applies, despite the use of the x- and y-spaced stiffener support wheels.

One familiar with the art to which the present invention pertains will appreciate from the numerous types of blind/cover arrangements that are disclosed here, that the present invention is applicable in general to horizontally traversing blinds or covers. Adaptation of the system to other blinds within this genre will be readily done by those of usual skill in the art, without undue experimentation. Indeed, in many cases, other blinds will be directly substituted for those disclosed here.

The present invention has been described in terms of a preferred and other embodiments. The invention, however, is not limited to the embodiments described and depicted. Rather the invention is defined by the claims appended hereto.

What is claimed is:

1. A hinge, comprising: a first relatively small hinge member having a generally c-shaped configuration of relatively small dimension in a plane transverse to the length of the first hinge member and a mating, second relatively large hinge member having a generally c-shaped configuration of relatively large dimension in a plane transverse to the length of the second hinge member;

the first and second hinge members each comprising continuous first, second and third sections;

the first and second sections of the first and second hinge members being substantially continuous curved sections of different curvature and the third section being a substantially planar lip;

the continuous first, second and third sections of the first and second hinge members forming an associated generally c-configured cavity and the first and third sections having respective outer ends defining an opening therebetween into the associated cavity;

the first section of the relatively large second hinge member being substantially entirely within and protruding into the associated cavity defined by the second hinge member, for engaging the first section of the mating, relatively small first hinge member as the hinge members pivot from a first limit of pivotal movement toward a second limit of pivotal movement, thereby shifting the outside surface of the relatively small first hinge member against the inner surface including the third, lip section of the relatively large second hinge member and capturing the relatively small first hinge member within the relatively large second hinge member; and the orientation of the curvature of the first section of the second hinge member being opposite the orientation of the curvature of the first and second sections of the first hinge member and of the second section of the second hinge member; and the relative dimensions of the radii $r_{xy}$ associated with the first and second sections being $r_{11}>r_{22}>r_{12}>r_{21}$, wherein x=1, 2 represents the first and second sections, and y=1, 2 represents the first and second hinge members;

whereby at one limit of pivotal movement of the hinge the inner surface of the first hinge member is captured against the inner surface including the lip of the second hinge member and at the opposite limit of pivotal movement the outside surface of the first hinge member is captured against the inner surface including the lip of the second hinge member.

2. The hinge of claim 1, wherein the relative dimensions of the radii $r_{11}$, $r_{22}$, $r_{12}$, and $r_{21}$ are, respectively, 0.437, 0.148, 0.131, and 0.097.

3. The hinge claim 1, wherein the relative dimensions of the radii $r_{11}$, $r_{22}$, $r_{12}$, and $r_{21}$ are, respectively, approximately 0.437, 0.148, 0.131, and 0.097; and wherein the arcs subtended by the radii $r_{11}$, $r_{22}$, $r_{12}$, and $r_{21}$ are, respectively, approximately 90°, 207°, 63° and 180°.

4. A hinge, comprising: a first relatively small hinge member having a generally c-shaped configuration of relatively small dimension in a plane transverse to the length of the first hinge member and defining a first cavity; and a mating, second relatively large hinge member having a generally c-shaped configuration of relatively large dimension in a plane transverse to the length of the second hinge member and defining a second cavity;

the first and second hinge members each comprising first and second curved sections; and the orientation of the curvature of the first section of the second hinge member being opposite the orientation of the curvature of the first and second sections of the first hinge member and of the second section of the second hinge member; and the first and second sections of the first and second hinge members having radii $r_{xy}$, the relative dimensions of the radii $r_{xy}$ being $r_{11}>r_{22}>r_{12}>r_{21}$, wherein x=1, 2 represents the first and second sections, and y=1, 2 represents the first and second hinge members.

5. The hinge of claim 4, wherein the relative dimensions of the radii $r_{11}$, $r_{22}$, $r_{12}$, and $r_{21}$ are, respectively, 0.437, 0.148, 0.131, and 0.097.

6. The hinge of claim 4, wherein the relative dimensions of the radii $r_{11}$, $r_{22}$, $r_{12}$, and $r_{21}$ are, respectively, approximately 0.437, 0.148, 0.131, and 0.097; and wherein the subtended by the radii $r_{11}$, $r_{22}$, $r_{12}$, and $r_{21}$ are, respectively, approximately 90°, 207°, 63° and 180°.

7. A hinge, comprising: a first relatively small hinge member having a generally c-shaped configuration of relatively small dimension in a plane transverse to the length of the first hinge member and a mating, second relatively large hinge member having a generally c-shaped configuration of relatively large dimension in a plane transverse to the length of the second hinge member;

the first and second hinge members each comprising continuous first, second and third sections;

the first and second sections of each of the first and second hinge members being substantially continuous curved sections of different curvature and the third section being a substantially planar lip;

the continuous first, second and third sections of the first hinge member forming an associated generally c-configured first cavity and the first and third sections having respective outer ends defining a first opening, between the first and third sections of the first hinge member and into the associated first cavity;

the continuous first, second and third sections of the second hinge member forming an associated generally c-configured second cavity and the first and third sections having respective outer ends defining a second opening, between the first and third sections of the second hinge member and into the associated second cavity;

the first and second sections of the first hinge member being inwardly concave relative to the associated first cavity; the first section of the second hinge member being inwardly convex relative to the associated second cavity; and the second section of the second hinge member being inwardly concave relative to the associated second cavity; and the first and second sections of the first and second hinge members having radii $r_{xy}$, the relative dimensions of the radii $r_{xy}$ being $r_{11}>r_{22}>r_{12}>r_{21}$, wherein x=1, 2 represents the first and second sections, and y=1, 2 represents the first and second hinge members; and the first section of the relatively large second hinge member being substantially entirely within and protruding into the associated first cavity for engaging the first section of the mating, relatively small first hinge member as the hinge members pivot from a first limit of pivotal movement toward a second limit of pivotal movement, thereby shifting the outside surface of the relatively small first hinge member against the inner surface of the relatively large second hinge member and capturing the relatively small first hinge member within the relatively large second hinge member.

8. The hinge of claim 7, wherein the relative dimensions of the radii $r_{11}$, $r_{22}$, $r_{12}$, and $r_{21}$ are, respectively, 0.437, 0.148, 0.131, and 0.097.

9. The hinge of claim 7, wherein the relative dimensions of the radii $r_{11}$, $r_{22}$, $r_{12}$, and $r_{21}$ are, respectively, approximately 0.437, 0.148, 0.131, and 0.097; and wherein the arcs subtended by the radii $r_{11}$, $r_{22}$, $r_{12}$, and $r_{21}$ are, respectively, approximately 90°, 207°, 63° and 180°.

10. A hinge comprising:

A) a first, relatively small hinge member having a generally c-shaped configuration of relatively small dimension in a plane transverse to the length of the hinge;

B) a second, relatively large hinge member adapted for receiving and mating with the first hinge member, the second hinge member having a generally c-shaped configuration of relatively large dimension in said transverse plane;

C) the first and second hinge members each comprising first, second and third sections in said transverse plane, the first and second sections of each of the first and second hinge members having substantially continuous, different radii and the third section of each of the first and second hinge members being a lip;

D) the first section, the second section and the third, lip section of the first, relatively small hinge member being joined together and forming the c-shaped configuration of relatively small dimension and defining a first cavity, within the first, second and third sections of the first hinge member; and the first section and the third, lip section of the first hinge member defining an opening therebetween into the first cavity;

E) the first section, the second section and the third, lip section of the second, relatively large hinge member being joined together and forming the c-shaped configuration of relatively large dimension and defining an associated second cavity within the first, second and third sections; and the first section and the third, lip section of the second hinge member defining an opening therebetween into the second cavity;

F) the orientation of the curvature of the radius of the first section of the second hinge member being opposite the orientation of the curvature of the radii of the first and second sections of the first hinge member and of the second section of the second hinge member; and G) the radii of the first and second sections of the first and second hinge members having relative dimensions $r_{xy}$, wherein x=1, 2 denotes the first and second sections, and y=1, 2 denotes the first and second hinge members; and wherein $r_{11}>r_{22}>r_{12}>r_{21}$.

11. The hinge of claim 10, wherein the relative radii dimensions $r_{11}$, $r_{22}$, $r_{12}$, and $r_{21}$ are approximately 0.437, 0.148, 0.131, and 0.097, respectively.

12. The hinge of claim 10, wherein the relative dimensions of the radii $r_{11}$, $r_{22}$, $r_{12}$, and $r_{21}$ are, respectively, approximately 0.437, 0.148, 0.131, and 0.097; and wherein the arcs subtended by the radii $r_{11}$, $r_{22}$, $r_{12}$, and $r_{21}$ are, respectively, approximately 90°, 207°, 63°, and 180°.

13. A slat blind system, comprising: a traverse track; a plurality of carriers suspended from the track for traversing along the track; an array of elongated slats mounted to and suspended from the carriers for opening and closing traversing movement along the track; and a plurality of hinges extending along a longitudinal section of and pivotally joining the slats;

A) each hinge comprising: a first, relatively small hinge member having a generally c-shaped configuration of relatively small dimension in a plane transverse to the length of the hinge, and the first hinge member extending along a longitudinal section of a first of a pair of adjacent slats; and a second, relatively large hinge member adapted for receiving and mating with the first hinge member, the second hinge member having a generally c-shaped configuration of relatively large dimension in said transverse plane, and the second hinge member extending along a longitudinal section of the second of said pair of slats corresponding to the longitudinal section along the first of said pair of slats occupied by the first hinge member;

B) the first and second hinge members each comprising first, second and third sections in said transverse plane, the first and second sections of each hinge member having substantially continuous, different radii and the third section of each hinge member being a lip;

C) the first section, the second section and the third, lip section of the first, relatively small hinge member being joined together and forming the c-shaped configuration of relatively small dimension and defining a first cavity, within the first, second and third sections of the first hinge member; and the first section and the third, lip section of the first hinge member defining an opening therebetween into the first cavity;

D) the first section, the second section and the third, lip section of the second, relatively large hinge member being joined together and forming the c-shaped configuration of relatively large dimension and defining a second cavity, within the first, second and third sections of the second hinge member; and the first section and the third, lip section of the second hinge member defining an opening therebetween into the second cavity;

E) the orientation of the curvature of the radius of the first section of the second hinge member being opposite the orientation of the curvature of the radii of the first and second sections of the first hinge member and of the second section of the second hinge member;

F) the relative dimensions of the radii associated with the first and second sections of the first and second hinge members decreasing in the order (1) the first section of the first hinge member, (2) the second section of the second hinge member, (3) the first section of the second hinge member, and (4) the second section of the first hinge member; and G) the first section of the relatively large second hinge member being substantially entirely within and protruding into the second cavity within the second hinge member, for engaging the first section of the relatively small first hinge member as the hinge members pivot from a first limit of pivotal movement toward a second limit of pivotal movement, thereby shifting the outside surface of the relatively small first hinge member against the inner surface including the third, lip section of the relatively large second hinge member and capturing the relatively small first hinge member within the relatively large second hinge member.

14. The slat blind system of claim 13, wherein the radii associated with the first and second sections of the first and second hinge members have relative dimensions $r_{xy}$, wherein x=1, 2 denotes the first and second sections and y=1, 2 denotes the first and second hinge members; and wherein $r_{11}$, $r_{22}$, $r_{12}$ and $r_{21}$ are approximately 0.437, 0.148, 0.131 and 0.097, respectively.

15. The slat blind system of claim 13, wherein the first and second hinge members of each hinge extend along substantially the length of said pair of slats.

16. The slat blind system of claim 13, wherein the radii associated with the first and second sections of the first and second hinge members have relative dimensions rxy, wherein x=1, 2 denotes the first and second sections and y=1, 2 denotes the first and second hinge members; wherein the relative dimensions of the radii $r_{11}$, $r_{22}$, $r_{12}$, and $r_{21}$ are, respectively, approximately 0.437, 0.148, 0.131, and 0.097; and wherein the arcs subtended by the radii $r_{11}$, $r_{22}$, $r_{12}$, and $r_{21}$ are, respectively, approximately 90°, 207°, 63° and 180°.

17. The slat blind system of claim 15, wherein the radii associated with the first and second sections of the first and second hinge members have relative dimensions rxy, wherein x=1, 2 denotes the first and second sections, and y=1, 2 denotes the first and second hinge members; wherein the relative dimensions of the radii $r_{11}$, $r_{22}$, $r_{12}$, and $r_{21}$ are, respectively, approximately 0.437, 0.148, 0.131, and 0.097; and wherein the arcs subtended by the radii $r_{11}$, $r_{22}$, $r_{12}$, and $r_{21}$ are, respectively, approximately 90°, 207°, 63°, and 180°.

18. A slat blind system, comprising: a traverse track; a plurality of carriers suspended from the track for traversing along the track; an array of elongated slats mounted to and suspended from the carriers for opening and closing traversing movement along the track; and a plurality of hinges extending along a longitudinal section of and pivotally joining the slats;

A) each hinge comprising: a first, relatively small hinge member having a generally c-shaped configuration of relatively small dimension in a plane transverse to the length of the hinge, and the first hinge member extending along a longitudinal section of a first of a pair of adjacent slats; and a second, relatively large hinge member adapted for receiving and mating with the first hinge member, the second hinge member having a generally c-shaped configuration of relatively large dimension in said transverse plane, and the second hinge member extending along a longitudinal section of the second of said pair of slats corresponding to the longitudinal section along the first of said pair of slats occupied by the first hinge member;

B) the first and second hinge members each comprising first, second and third sections in said transverse plane, the first and second sections of each hinge member having substantially continuous, different radii and the third section of each hinge member being a lip;

C) the first section, the second section and the third, lip section of the first, relatively small hinge member being joined together and forming the c-shaped configuration of relatively small dimension and defining a first cavity, within the first, second and third sections of the first hinge member; and the first section and the third, lip section of the first hinge member defining an opening therebetween into the first cavity;

D) the first section, the second section and the third, lip section of the second, relatively large hinge member being joined together and forming the c-shaped configuration of relatively large dimension and defining a second cavity, within the first, second and third sections of the second hinge member; and the first section and the third, lip section of the second hinge member defining an opening therebetween into the second cavity;

E) the orientation of the curvature of the radius of the first section of the second hinge member being opposite the orientation of the curvature of the radii of the first and second sections of the first hinge member and of the second section of the second hinge member;

F) the radii of the first and second sections of the first and second hinge members having relative dimensions $r_{xy}$ wherein x=1, 2 denotes the first and second sections, and y=1, 2 denotes the first and second hinge members; and wherein $r_{11}>r_{22}>r_{12}>r_{21}$; and G) the first section of the relatively large second hinge member being substantially entirely within and protruding into the second cavity within the second hinge member, for engaging the first section of the relatively small first hinge member as the hinge members pivot from a first limit of pivotal movement toward a second limit of pivotal movement, thereby shifting the outside surface of the relatively small first hinge member against the inner surface including the third, lip section of the relatively large second hinge member and capturing the relatively small first hinge member within the relatively large second hinge member.

19. The slat blind system of claim 18, wherein $r_{11}$, $r_{22}$, $r_{12}$, and $r_{21}$ are approximately 0.437, 0.148, 0.131, and 0.097, respectively.

20. The slat blind system of claim 18, wherein the first and second hinge members of each hinge extend along substantially the length of said pair of slats.

21. The slat blind system of claim 18, wherein the relative dimensions of the radii $r_{11}$, $r_{22}$, $r_{12}$, and $r_{21}$ are, respectively, approximately 0.437, 0.148, 0.131, and 0.097; and wherein the arcs subtended by the radii $r_{11}$, $r_{22}$, $r_{12}$, and $r_{21}$ are, respectively, approximately 90°, 207°, 63° and 180°.

22. The slat blind system of claim 20, wherein the relative dimensions of the radii $r_{11}$, $r_{22}$, $r_{12}$, and $r_{21}$ are, respectively, approximately 0.437, 0.148, 0.131, and 0.097; and wherein the arcs subtended by the radii $r_{11}$, $r_{22}$, $r_{12}$, and $r_{21}$ are, respectively, approximately 90°, 207°, 63° and 180°.

* * * * *